US006249657B1

(12) United States Patent
Kagawa

(10) Patent No.: US 6,249,657 B1
(45) Date of Patent: Jun. 19, 2001

(54) ONE-WAY HEAT FIXING DEVICE FOR FIXING DEVELOPERS ON A RECORDING MEDIUM AND A METHOD THEREFOR

(75) Inventor: Toshiaki Kagawa, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/505,125

(22) Filed: Feb. 16, 2000

(30) Foreign Application Priority Data

Feb. 16, 1999 (JP) ..... 11-037353

(51) Int. Cl.[7] ..... G03G 15/20
(52) U.S. Cl. ..... 399/67; 399/69
(58) Field of Search ..... 399/67, 68, 69, 399/328, 330, 337, 332; 219/216, 200, 469

(56) References Cited

U.S. PATENT DOCUMENTS 5,701,554 12/1997 Tanaka et al. ..... 399/69
6,006,052 * 12/1999 Kamimura et al. ..... 399/69

FOREIGN PATENT DOCUMENTS 7-334023 12/1995 (JP) .

* cited by examiner

*Primary Examiner*—Arthur T. Grimley
*Assistant Examiner*—Hoan Tran

(74) *Attorney, Agent, or Firm*—Dike Bronstein Roberts & Cushman IP Group Edwards & Angell LLP; David G. Conlin; George W. Hartnell, III

(57) ABSTRACT

The present invention provides a one-way heat fixing device for developers in which thermal energy from the fixing roller is provided to the unfixed developer on a recording medium. The fixing device includes a fixing roller, which is heated to and maintained at a predetermined temperature, and a pressing roller, which maintains contact with the fixing roller. Recording media carrying an unfixed developer thereon are contacted between the fixing roller and the pressing roller so that at the moment of fixing the developer, the magnitude of thermal energy (Qh) to be fed from the fixing roller to the developer and the recording medium, and the magnitude of thermal energy (Qp) to be fed from the pressing roller to the developer and the recording medium is defined by the following formula:

$$Qp/Qh \leqq 0.7$$

and the temperature difference between the temperature of the uppermost layer of the developer and the temperature of the lowermost layer of the developer is maintained in accordance with the following formula:

$$\Delta t \geqq 0.135\ (Wn/Vp)^{-1.26}$$

wherein Wn is the width (in mm) of the press-contact portion of the recording medium and Vp (in mm/sec) is the transferring speed of the device.

11 Claims, 17 Drawing Sheets

ONE-WAY HEAT FIXING DEVICE FOR FIXING DEVELOPERS ON A RECORDING MEDIUM AND A METHOD THEREFOR

BACKGROUND OF THE INVENTION

The present invention relates to the device and method for fixing a developer, and in particular, to the device and method for fixing a developer which are useful for an electrophotographic process.

As an apparatus making use of an electrophotographic process, such as a copying machine, a facsimile terminal equipment, a printer, etc., there are generally known various types such as a diazo type, an EF type, a PPC (Plain Paper Copier), etc. Among these types of apparatus, the PPC is currently most extensively employed. This PPC is constituted, as a basic structure, by various members for carrying out an electrification step, an exposing step, a developing step, a transferring step, and a fixing step, as well as an additional member for carrying out a cleaning step.

Namely, according to this PPC, the electrophotographic process thereof comprises a step of electrification wherein a photosensitive body is entirely exposed to a corona discharge so as to uniformly generate an electric charge (ion) on the surface of the photosensitive body; a step of exposure wherein a reflected light of a light source such as a halogen lamp is projected through an optical system comprising lenses and etc. onto the surface of the photosensitive body to form a shaded image thereon, thereby leaving the electric charge in the region where the reflected light is not irradiated so as to form an electrostatic latent image thereon; a step of development wherein a developer (toner) is electrically attracted to the electric charge on the surface of the photosensitive body thereby performing the development of the electrostatic latent image; a step of transferring wherein the surface of the photosensitive body bearing the toner image thereon is caused to contact with the surface of recording material (recording paper) and a corona discharge is again applied to the back surface of the recording paper thereby causing the toner to transfer to the recording paper, a cleaning step wherein the toner that remained on the surface of the photosensitive body is wiped off, thereby making the photosensitive body to be repeatedly usable, a fixing step wherein the toner adhered onto the recording paper through a weak electrostatic attractive force is caused to melt, thereby fixing the toner to the recording paper.

In this fixing step, the system which is currently most extensively employed therefor is a heat roller fixing system. According to this heat roller fixing system, a heating energy is supplied from a pair of heated and press-contacted rollers each being formed of a hollow metallic roller which is provided at the center thereof with a heater to the recording paper bearing an unfixed toner image and passing through this pair of heated rollers, thereby fixing the toner image to the recording paper (a two-way heat fixing method) (for example, Japanese Patent Unexamined Publication H5-188807).

However, there is a problem in this heat roller fixing system employing the two-way heat fixing method that comprises a so-called high temperature off-set phenomenon where the melted toner is caused to adhere onto the fixing roller which is disposed on the image-fixing side is more likely to be generated.

In the meantime, since a color toner requires a larger quantity of thermal energy for this fixing as compared with a monochrome toner and at the same time, requires a higher grossness to the recording paper as well as a higher transmittance to the OHP as compared with a monochrome toner, the color toner is generally constituted by a resin which is more excellent in so-called sharp melt as compared with the monochrome toner. Therefore, since the aforementioned two-way heat fixing method is generally employed, and moreover, since the segmentation of toner tends to be generated due to a decrease in cohesive force between the toner particles in the electrophotographic apparatus which makes use of a color toner, the high temperature off-set phenomenon is caused to be generated more prominently.

Under the circumstances, it becomes absolutely necessary, in the case of the conventional fixing device of electrophotographic apparatus making use of a color toner, to coat an off-set preventive agent such as a silicone oil on the surface of the roller in order to minimize the surface energy.

In this case, the coating and supply of an off-set preventive agent are generally performed by coating means such as a coating roller which is designed to be contacted with a fixing roller. However, this coating means is accompanied with various problems such as (1) the mechanism for uniformly coating the oil is complicated, thus inviting an increase in the manufacturing cost of the fixing device; (2) Once the oil is spilled out of the fixing device, it will badly affect the other steps (such as development and transferring) of the electrophotographic apparatus; (3) while the image printed by the electrophotographic apparatus is demanded to be higher in grossness, an increase in coating of the oil will most likely give rise to a deterioration of transmittance to the OHP and to the generation of image defects such as the generation of oil lines; (4) A periodical maintenance of the supply of oil for instance is required so that the aforementioned coating means is not user-friendly.

Therefore, it is now desired to develop a device and method for fixing the color toner, which make it possible to enlarge a region in which not only a sufficient strength of fixing can be realized irrespective of the specifications of recording paper (a thick paper as well as a thin paper), but also the off-set phenomenon can be prevented to occur (i.e. a fixable region).

On the other hand, an electrophotographic apparatus which makes use of a monochrome toner is frequently subjected to a long period of continuous fixing operation such as a multi-printing, etc. In this case, the heat of the fixing roller is transmitted to the pressing roller, thereby minimizing the difference in temperature between the fixing roller and the pressing roller, thus causing the high temperature off-set phenomenon to tend to be generated. In recent years, in order to overcome this problem, measurements have been taken to add a wax to a toner so as to minimize the high temperature off-set phenomenon, and at the same time, a fixing apparatus which makes it possible to realize an oil-less operation has been put to practical use. However, there are still problems that (1) when the releasability of the covering layer formed on the surface of the fixing roller is deteriorated due to a long period of use, the fixable region is caused to become narrow, thereby giving rise to the generation of the off-set phenomenon especially when a thin recording paper is employed; (2) when a recording paper which is smaller in width than that of the fixing roller is continuously fed to the fixing roller, the portion of the fixing roller which is not contacted with the recording paper is caused to rise in temperature, so that when a recording paper of the ordinary size is subsequently fed to the fixing roller, the high temperature off-set phenomenon is caused to generate, and (3) when a wax is added to a toner, the mechanical strength of the toner resin is caused to become lower, or the wax may be caused to melt at the occasion of kneading a binary developer consisting of the toner and a carrier, thereby deteriorating the dispersion of toner, etc. Therefore, it is now desired to develop an apparatus and method for fixing a monochrome toner, which is capable of minimizing the generation of the high temperature off-set phenomenon without necessitating the addition of a wax to the toner.

Further, the reduction of power consumption becomes an important problem in recent years in view of protecting the environment, so that it now becomes imperative to minimize the power consumption at the fixing device portion where the power consumption is the highest in the electrophotographic apparatus. However, according to the heat roller fixing system where the two-way heat fixing is employed, the magnitude of thermal energy to be consumed for the recording paper, in addition to that to be consumed for the toner, is relatively large, and it is impossible to reduce the power consumption in the aforementioned conventional heat roller fixing system.

Under the circumstances, Japanese Patent Unexamined Publication H7-334023 describes a fixing device wherein the temperature of a pressing roller is controlled to alter based on the measured value of the magnitude of power fed to a recording paper from a fixing roller immediately before the recording paper is transferred to the fixing device, thereby making it unnecessary to detect the temperature of the pressing roller. However, this fixing device disclosed therein also adopts the heat roller fixing system where the two-way heat fixing is employed. Namely, according to this fixing device, a one-way heat fixing system where a thermal energy is supplied only through the developer layer side is not taken into account at all.

BRIEF SUMMARY OF THE INVENTION

The present invention has been accomplished in view of the aforementioned problems, and therefore, an object of the present invention is to provide an apparatus and method for fixing a developer, wherein a one-way heat fixing system where a thermal energy is supplied only through the developer layer side is adopted, and which are capable of enlarging the fixable region.

With a view to realize the aforementioned object, the present invention provides a fixing device for developers, which comprises a fixing member adapted to be heated, and a pressing member adapted to be contacted with said fixing member, wherein a recording member carrying an unfixed developer thereon is transferred to an interface between said fixing member and said pressing member so as to allow the surface carrying said unfixed developer thereon to be contacted with said fixing member; which is characterized in that;

a magnitude of thermal energy (Qh) to be fed from the fixing member to the developer and the recording material, and a magnitude of thermal energy (Qp) to be fed from the pressing member to the developer and the recording material at the moment of fixing process of the developer by means of the fixing member and the pressing member meets the following formula:

$$Qp/Qh \leqq 0.7$$

wherein said magnitude of thermal energy is calculated immediately before the fixing from the temperatures of said developer, said recording material, said fixing member and said pressing member.

The present invention also provides a fixing device for developers, wherein a difference in temperature between the temperature of an uppermost layer of a developer and the temperature of a lowermost layer of a developer is represented by the following formula:

$$\Delta t \geqq 0.135\ (Wn/Vp)^{-1.26}$$

wherein $\Delta t$ is a difference in temperature between the temperature of an uppermost layer of a developer and the temperature of a lowermost layer of a developer at the moment of finishing the fixing, each of said temperatures being calculated immediately before the fixing from the temperatures of said developer, said recording material, said fixing member and said pressing member; Vp is a transferring speed (mm/sec ) of said recording material; and Wn is a width (mm) of a press-contacted portion to be formed between said fixing member and said pressing member in the transferring direction of said recording material.

According to a preferable embodiment of said fixing device, the relationship between said Vp and said Wn are represented by the following formula:

$$Wn/Vp \geqq 0.047\ (\text{sec.})$$

wherein Vp is a transferring speed (mm/sec) of said recording material; and Wn is a width (mm) of a press-contacted portion to be formed between said fixing member and said pressing member in the transferring direction of said recording material.

According to another preferable embodiment of said fixing device, a relationship between a thermal conductivity of said fixing member and a thermal conductivity of said pressing member is represented by the following formula:

$$\lambda h \geqq \lambda p$$

wherein $\lambda$ is a thermal conductivity of said fixing member; and $\lambda p$ is a thermal conductivity of said pressing member.

According to another preferable embodiment of the fixing device for developers according to the present invention, said developer is a color toner, said fixing member is impregnated with an off-set preventive agent, or said developer is a monochrome toner containing no wax.

Further, according to another preferable embodiment of the fixing device for developers according to the present invention, said recording material has a basis weight of 184 $g/m^2$ or more.

According to another preferable embodiment of the fixing device for developers according to the present invention, said pressing member is provided with a detachable contacting mechanism which can be detached from said fixing member, or with an endless belt which is wound around said fixing member.

Further, according to the present invention, there is provided a method of fixing developers, which is adapted to be employed in the aforementioned fixing device.

According to the fixing device for developers of the present invention, since it is designed to measure the relationship between the magnitude Qh of thermal energy to be fed from said fixing member and the magnitude Qp of thermal energy to be fed from said pressing member, it is possible, irrespective of the kinds of recording materials, to enable the thermal energy to be transmitted to a toner image at substantially a constant magnitude, so that even if the quantity of oil coated on the fixing roller is relatively small, a wide fixable region can be obtained.

Further, according to the fixing device for developers of the present invention, since it is designed to measure the relationship among the difference in temperature $\Delta t$ between the temperature of an uppermost layer of a developer and the temperature of a lowermost layer of a developer at the moment of finishing the fixing, the transferring speed Vp of the recording material, and the width Wn of a press-contacted portion to be formed between the fixing member and the pressing member in the transferring direction of the recording material, the fixing strength of toner images can be enhanced, and at the same time, an image of high grossness can be obtained.

Further, according to the fixing device for developers of the present invention, since it is designed to measure the relationship between the transferring speed Vp of the recording material, and the width Wn of the aforementioned press-contacted portion, it is possible, irrespective of the kinds of recording materials, to enable a wide fixable region to be secured.

Furthermore, according to the fixing device for developers of the present invention, since it is designed to measure the relationship between the thermal conductivity $\lambda h$ of the fixing member; and the thermal conductivity $\lambda p$ of the pressing member, the fixable region can be shifted to the lower temperature side relative to the temperature of the fixing member, it is possible, irrespective of the critical temperature for usage of the fixing roller, to enable a wide fixable region to be secured.

Additionally, according to the fixing device for developers of the present invention, since the fixing member is impregnated with an off-set preventive agent, it is possible, even if a color toner is employed, to secure a wide fixable region by making use of such a small quantity of the off-set preventive agent that can be impregnated into the fixing member, so that the aforementioned various problems accompanied with a large quantity of coating of the off-set preventive agent can be overcome.

Further, according to the present invention, even if the developer is formed of a monochrome toner containing no wax, a wide fixable region can be secured, thus making it possible to overcome the aforementioned various problems accompanied with the inclusion of a wax.

It is possible, through the employment of a recording material having a basis weight of 184 g/m$^2$ or more, to determine the lower limiting line for fixing of the fixable region by way of only the temperature of the fixing member almost irrespective of the temperature of the pressing member, thereby making it particularly suited for use in a one-way heat fixing method.

Further, since the pressing member is provided with a detachable contacting mechanism which can be detached from said fixing member, the heat transfer from the fixing member to the pressing member at the interval between one recording paper and the next recording paper can be inhibited, thereby making it possible to keep the pressing member in a low temperature condition. As a result, the aforementioned one-way heat fixing system can be easily realized.

Further, when the pressing member is provided with an endless belt, it is possible to improve the heat-radiating property of the fixing device, and at the same time, to make the fixing device especially suitable for use in the aforementioned one-way heat fixing system due to the effect of the endless belt to maintain the pressing member in a low temperature state. When this endless belt is wound around the fixing member, the press-contacted portion having a larger width can be ensured. As a result, the temperature of the fixing member can be lowered, thus making it possible, irrespective of the critical temperature for usage of the fixing roller, to enable a wide fixable region to be secured.

Further, according to the method of fixing developers where the aforementioned fixing member is to be employed, the quantity of an off-set preventive agent to be used therein can be reduced when a color toner is to be employed, and the addition of a wax is no more required when a monochrome toner is to be employed, thus resulting in the saving of cost and in the reduction of power consumption.

DETAILED DESCRIPTION OF THE INVENTION

The device and method of fixing developers according to one embodiment of the present invention will be explained in details below with reference to the drawings.

Figure 1:
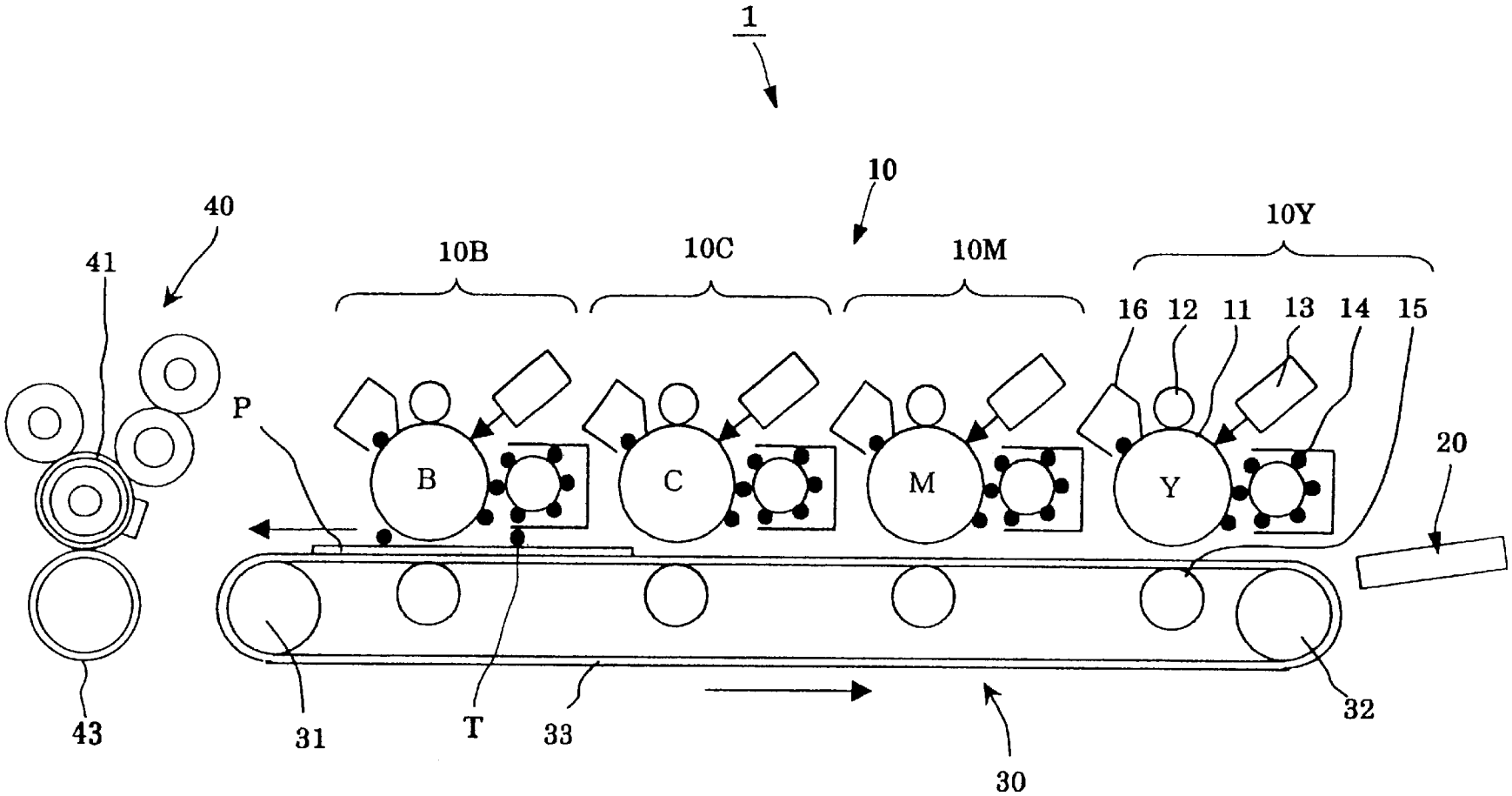
FIG. 1 is a schematic view illustrating the construction of a color laser printer provided with a fixing device representing a first embodiment of the present invention.
Figure 2:
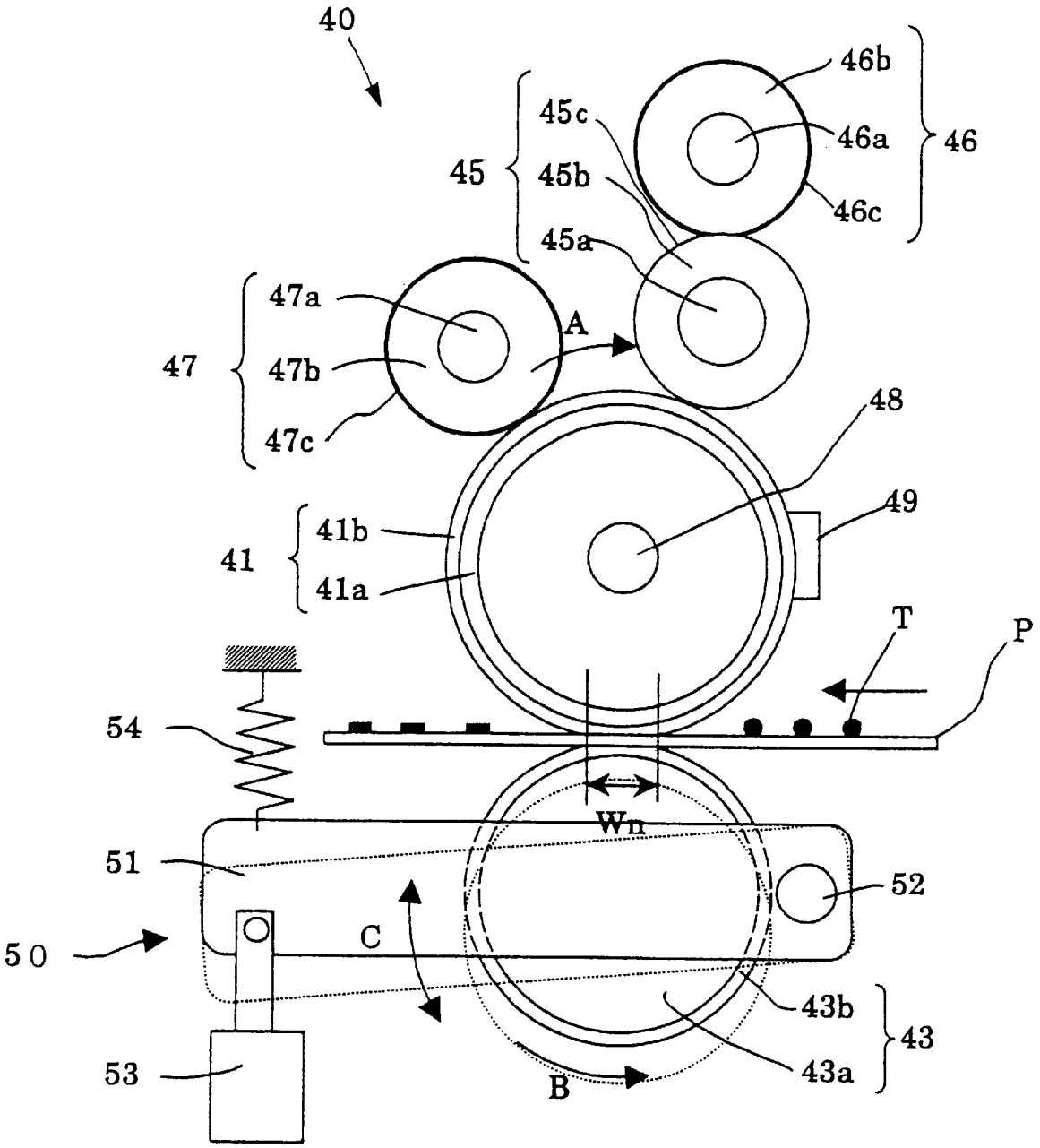
FIG. 2 is an enlarged schematic view illustrating the construction of the fixing device of FIG. 1.

FIG. 1 shows a color laser printer 1 provided with a fixing device 40 according to a first embodiment, while FIG. 2 illustrates an enlarged view of the fixing device 40.

As shown in FIG. 1, the color laser printer 1 is composed of an optical system which is constituted by a semiconductor laser (not shown), lenses (not shown), etc., and the PPC which is constituted by various processing portions including electrification, exposure, development, transferring, cleaning and fixing. Specifically, this PPC is constituted by a visual image forming unit 10, a recording paper (recording material) feeding tray 20, a recording paper transferring means 30, and a fixing device 40. This laser printer 1 is of so-called tandem type printer wherein the visual image forming unit 10 is disposed along the traveling passageway of a recording paper P so as to be contiguously interposed between the recording paper feeding tray 20 and the fixing device 40. After each color toner is multi-transferred to the recording paper P, the toners are allowed to be fixed at the fixing device 40 so as to form a full color image.

The visual image forming unit 10 is constituted by visual image-forming units of four colors, i.e. a unit 10Y, a unit 10M, a unit 10C and a unit 10B. Around the circumference of each photosensitive drum 11 of each color unit, there are disposed an electrification roller 12, a laser beam-irradiating means 13, a developing device 14, a transfer roller 15 and a cleaner 16. Color toners of yellow (Y), magenta (M), cyan (C) and black (B) are respectively placed in the respective developing device 14 of these color units.

The recording paper transferring means 30 is constituted by a driving roller 31, an idling roller 32 and a transferring belt 33. It is designed that the recording paper P is transported on an endless transporting belt 33 which is rotatably disposed bridging the driving roller 31 and the idling roller 32, the endless transporting belt 33 being controlled to rotate at a predetermined peripheral velocity.

After the surface of the photosensitive drum 11 is uniformly electrified by means of the electrification roller 12, laser beam is irradiated by means of the laser beam-irradiating means 13 to the surface of the photosensitive drum 11 in conformity with the image information, thereby forming an electrostatic latent image on the surface of the photosensitive drum 11. This electrostatic latent image is then developed by means of the developing device 14 to thereby form a toner image. On the other hand, the recording paper P is superimposed by the photosensitive drum 11, and the toner images of each color are successively transferred to the recording paper P by means of the transfer rollers 15 which are respectively impressed by a bias voltage whose polarity is opposite to the toner T. Thereafter, due to the curvature of the driving roller 31, the recording paper P is peeled away from the transferring belt 33 and then, transported to fixing device 40. On the other hand, the toner remained on the surface of the photosensitive drum 11 is wiped away by the cleaner 16, thereby allowing the printer 1 to be repeatedly used.

The fixing device 40 is constituted by a fixing roller 41, a pressing roller 43, a donor roller 45, an oil roller 46 and a cleaning roller 47. In this case, the one-way heat fixing method is adopted wherein only the fixing roller 41 which has been heated to a predetermined temperature is designed to give a thermal energy to the recording paper P from the toner T side so as to melt the toner T, and a predetermined pressure is given to the recording paper P by the effects of the fixing roller 41 and the pressing roller 43, thereby fixing the toner T and forming an image of excellent fastness on the recording paper p.

The fixing roller 41 is formed of a fixing member having an outer diameter of 40 mm and actuated, by way of a driving means (not shown), to rotate in the direction indicated by the arrow A. This fixing roller 41 comprises an aluminum hollow core 41*a* (2 mm in wall thickness), on the external wall of which a covering layer 41*b* is formed. This covering layer 41*b* is impregnated (through dipping) with an off-set preventive agent, and a heater lamp 48 (rated output: 800 W) is attached as a heat source to the inner wall of the hollow core 41*a*, thereby making it possible to heat the surface of the fixing roller 41 to a predetermined temperature.

The covering layer 41*b* is formed of a three-ply structure comprising a lower layer which is formed, through a cast molding, of a high heat conductive HTV (High Temperature Vulcanizing) silicone rubber (heat conductivity: 0.48 W/m° C.), an intermediate layer formed of a fluoro-rubber, and an upper layer which is formed, through a spray coating, of a low heat conductive LTV (Low Temperature Vulcanizing) silicone rubber (heat conductivity: 0.21 W/m° C.). As for the thickness of each layer of the covering layer 41*b*, the lower layer is 1.32 mm in thickness, the intermediate layer is 0.05 mm in thickness, and the upper layer is 0.13 mm in thickness. As for the off-set preventive agent, a dimethyl silicone oil having a viscosity of 100 cst (Shinetsu Kagaku Co., Ltd.; KF-96) can be employed.

The pressing roller 43 is formed of a pressing member having an outer diameter of 35 mm and actuated. This pressing roller 43 comprises a stainless steel core 43*a* (32 mm in diameter), on the external wall of which an LTV silicone rubber layer 43*b* (thickness: 1.5 mm) is formed. This pressing roller 43 is designed to be rotated in the direction indicated by the arrow B as it is driven by the fixing roller 41, and is supported by a detachable contacting mechanism 50 which is designed to move to or away from the fixing roller 41 as indicated by the arrow C.

The detachable contacting mechanism 50 is constituted by a bracket 51, a rotatable shaft 52, a solenoid 53 and a pressing spring 54. The bracket 51 houses therein a pressing roller 43, rotatably supporting the pressing roller 43, and is enabled to rotate in the direction indicated by the arrow C about the rotatable shaft 52 which is disposed at one end portion of the bracket 51. The rotatable shaft 52 is axially supported by the frame (not shown) of the fixing device 40. The solenoid 53 is attached to the lower side of the other end portion of the bracket 51, and the pressing spring 54 is attached to the upper side of the other end portion of the bracket 51.

When the solenoid 53 is turned OFF, the bracket 51 is pulled upward by means of the pressing spring 54. As a result, a predetermined pressure (a linear pressure of 1 N/mm in this embodiment) is applied via the pressing roller 43 to the fixing roller 41, i.e. to the recording paper P. On the other hand, when the solenoid 53 is turned ON, the bracket 51 is pulled downward by the effect of the solenoid 53 against the pulling force of the pressing spring 54. As a result, the pressing roller 53 can be detached from the fixing roller 41.

The symbol Wn shown in FIG. 2 denotes the fixing nip portion or the press-contacted portion in the traveling direction of the recording paper P that can be formed by the contact between the fixing roller 41 and the pressing roller 43.

The donor roller 45 is formed of a two-ply roller having a diameter of 20 mm, which comprises a stainless steel core 45*a* (10 mm in diameter), on the outer surface of which a heat resistant elastic layer 45*b* and a releasing layer 45*c* are successively formed. This donor roller 45 is connected through a gear connecting means (not shown) with the fixing roller 41, and is designed to be rotated at the same peripheral velocity as that of the fixing roller 41. In this embodiment, the heat resistant elastic layer 45*b* is formed of an HTV silicone rubber (about 5 mm in thickness), and the releasing layer 45*c* is formed of an LTV silicone rubber (about 40 $\mu$m in thickness)

The oil roller 46 is formed of a two-ply roller comprising a stainless steel core 46*a* (8 mm in diameter), on the outer surface of which an oil retaining layer 46*b* for impregnating an oil and an oil controlling layer 46*c* for controlling the exudation of oil are successively formed. The oil exuded from the oil roller 46 is enabled, via the donor roller 45, to spread uniformly over the surface of the fixing roller 41. In this embodiment, the oil retaining layer 46*b* is formed of a winding of rock wool paper (5.5 mm in thickness), and the oil controlling layer 46*c* is formed of a winding of normex paper (tradename; DuPont Co., Ltd. 0.5 mm in thickness), wherein the quantity of oil to be coated is set to 2 mg/A4 (2 mg per recording paper of A4 size).

The cleaning roller 47 is formed of a two-ply roller comprising a stainless steel core 47*a* (8 mm in diameter), on the outer surface of which a heat insulating layer 47*b* and a cleaner layer 47*c* are successively formed. This cleaning roller 47 is connected through a gear connecting means (not shown) with the fixing roller 41, and is designed to be rotated at the same peripheral velocity as that of the fixing roller 41. In this embodiment, the heat insulating layer 47*b* is formed of a winding of rock wool paper (5.5 mm in thickness), and the cleaner layer 47*c* is formed of a winding of normex paper (0.5 mm in thickness).

A thermistor 49 for detecting the surface temperature of the fixing roller 41 is disposed in the vicinity of the inlet side of the recording paper P in the fixing nip portion Wn. The signal detected by the thermistor 49 is designed to be transmitted not only to a current control circuit (not shown), but also to a detachable contacting mechanism control circuit (not shown) of the pressing roller 43, thereby achieving the control of current to a heater lamp 48 and the control of the detaching and approaching operation of the pressing roller 43.

The warm-up of the printer 1 can be accomplished by a process wherein the heater lamp 48 is turned ON under the condition where the fixing roller 41 is suspended, thereby allowing the surface of the fixing roller 41 to rise up to a predetermined temperature (170° C. in this embodiment). The recording paper P carrying an unfixed toner image T that has been formed by means of the visual image forming unit 10 is transported so as to be press-contacted by both of the pressing roller 43 and the fixing roller 41 at the moment when the pressing roller 43 is actuated by the movement of the detachable contacting mechanism 50 in conformity with the transferring timing of the recording paper P to the fixing device 40. As a result, the fixing of the toner T is accomplished. By the way, the pressing roller 43 is kept detached from the fixing roller 41 at the interval between one recording paper P and the next recording paper P in the continuous operation of printing.

FIG. 3 through FIG. 7 illustrate the relationship between the temperatures of the fixing roller 41 and of the pressing roller 43 and the fixable region of developers. In this case, the facts that the fixable region which enables to achieve the improvement of the fixing strength in a thick paper and to prevent the generation of off-set phenomenon in a thin paper will be demonstrated at first by way of experiments. Thereafter, this fixable region will be theoretically elucidated.

If the heat resistance temperature (critical temperature for usage) of the fixing roller 41 is not taken into account, the fixable region can be represented generally by a region encircled by a critical region where a high temperature off-set would not be generated at the toner 1-layer of a thin paper (52 g/m$^2$ paper) (off-set limit 1), by a region where a high temperature off-set would not be generated at the toner 1-layer of a thick paper (128 g/m$^2$ paper) (off-set limit 2), by a critical region where a defective fixing would not be generated at the toner 3-layer of a thin paper (fixing limit 1), and by a critical region where a defective fixing would not be generated at the toner 3-layer of a thick paper (fixing limit 2).

The fixing limit of thin paper (fixing limit 1) is located on the lower temperature side as compared with the fixing limit of thick paper (fixing limit 2), and at the same time, the off-set limit of thick paper (off-set limit 2) is located on the higher temperature side as compared with the off-set limit of thin paper (off-set limit 1), so that the fixable region is assumed to agree with the region encircled by the fixing limit 2 of thick paper and by the off-set limit 1 of thin paper.

Figure 3:
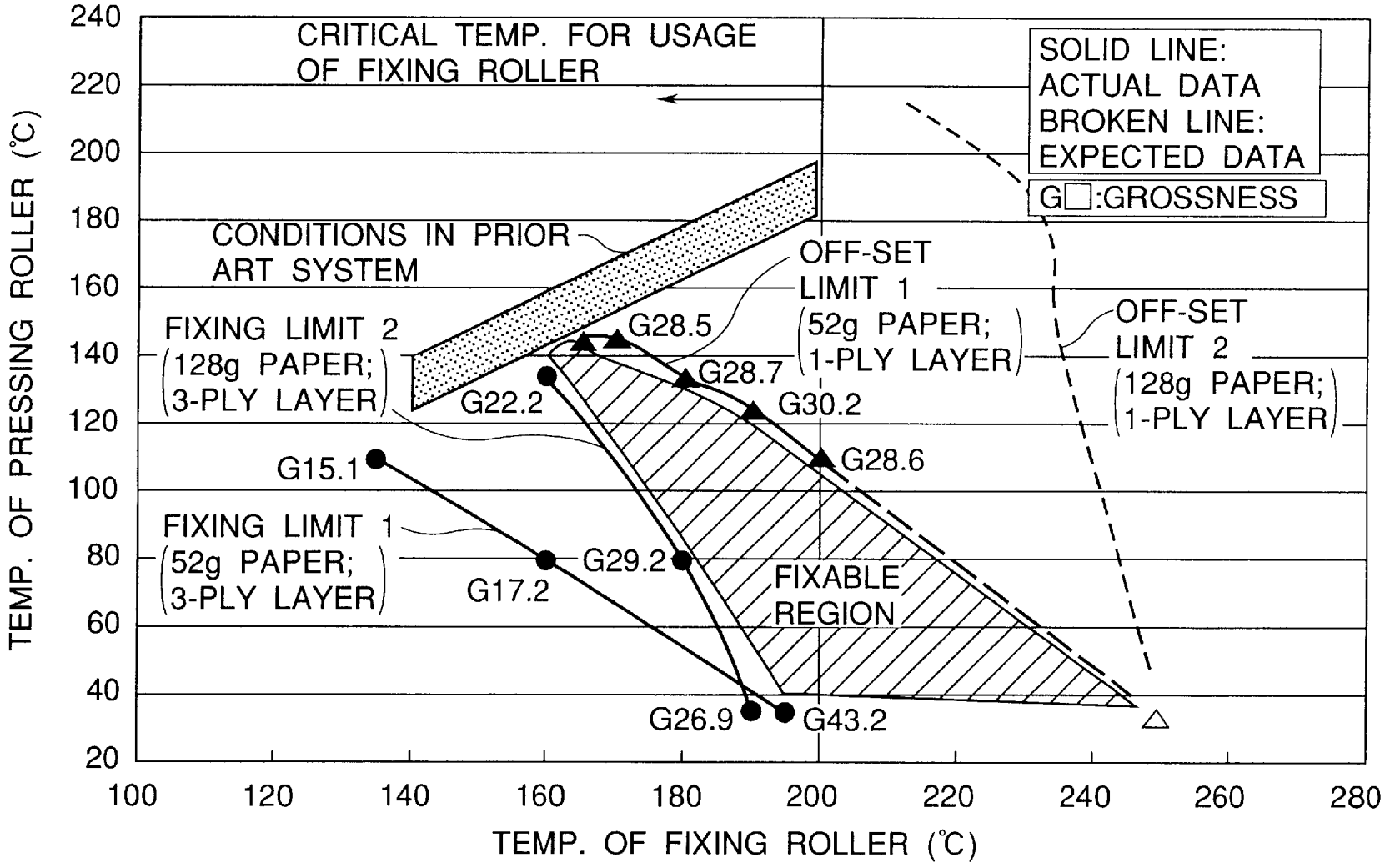
FIG. 3 is a diagram illustrating the result of experiment on the fixable region of a toner in the fixing device shown in FIG. 1.

FIG. 3 shows the result of experiment on the fixable region in the one-way heat fixing method.

The toner T employed in this experiment was formed of a color toner comprising a polyester resin having a glass transition point of 52° C. and a softening point of 97° C. As for the recording paper P, a thin paper having a basis weight of 52 g/m$^2$ and a thick paper having a basis weight of 128 g/m$^2$ were employed. An unfixed toner image T (a toner layer comprising three patterns of the first, second and third layers) of 100% printing was formed on the surface of the recording paper P.

A non-contact radiation thermometer (not shown) for measuring the surface temperature of each of the fixing roller 41 and the pressing roller 43 is disposed on the paper-feeding side of the recording paper P, and the fixing roller 41 is set to a predetermined temperature so as to perform the fixing of the toner T. The fixing rate (recording paper transferring speed) Vp is set to 85 mm/sec, and the fixing nip width Wn (the width of press-contacted portion in the traveling direction of the recording paper P formed between the fixing roller 41 and the pressing roller 43) is set to 4 mm.

As shown in FIG. 3, the fixable region is the region which is encircled by the fixing limit 2 and by the off-set limit 1 (shown by shading in FIG. 3). In this experiment, the high temperature off-set phenomenon of thick paper was not generated under the temperature condition which is lower than the critical temperature for usage (200° C.) of the fixing roller 41, so that the off-set limit 2 is shown therein by a broken line.

On the other hand, the condition for employment in the conventional fixing device (employment condition in the conventional system) is a region indicated by a dot pattern. This can be explained as follows. Namely, according to the conventional color fixing device, the two-way heat fixing method is generally employed, and in the case of a monochrome fixing device for carrying out a continuous fixing operation, the temperature of the pressing roller 43 becomes almost identical with the temperature of the fixing roller 41 due to the heat transfer from the fixing roller 41.

Therefore, it will be seen that since the employment condition in the conventional system does not overlap with the fixable region of this experiment, there is no fixable region which enables to realize not only the improvement of fixing strength of thick paper but also the prevention of off-set phenomenon of thin paper. Therefore, according to the conventional color fixing device, a large quantity of oil is required to be coated on the surface of the fixing roller. Further, according to the conventional monochrome fixing device, a wax is required to be added to the toner so as to expand the off-set limit toward a high temperature side, thereby making it possible to realize the aforementioned fixable region.

By the way, as seen from FIG. 3, since the inclination (absolute value) of the line of the fixing limit 2 is larger as compared with the inclination (absolute value) of the line of the off-set limit 1, the fixable region can be enlarged in proportion to an increase in difference of temperature between the fixing roller 41 and the pressing roller 43 (a the temperature of the pressing roller 43 is lower), unless the critical temperature for usage (200° C. in this experiment) is taken into account. Further, the grossness G (indicated by G43.2 for instance in FIG. 3) can be increased at the fixing limit 1 as well as at the fixing limit 2 in proportion to an increase in difference of temperature between the fixing roller 41 and the pressing roller 43.

Next, the fixable region in the one-way heat fixing method will be theoretically elucidated.

Figure 4:
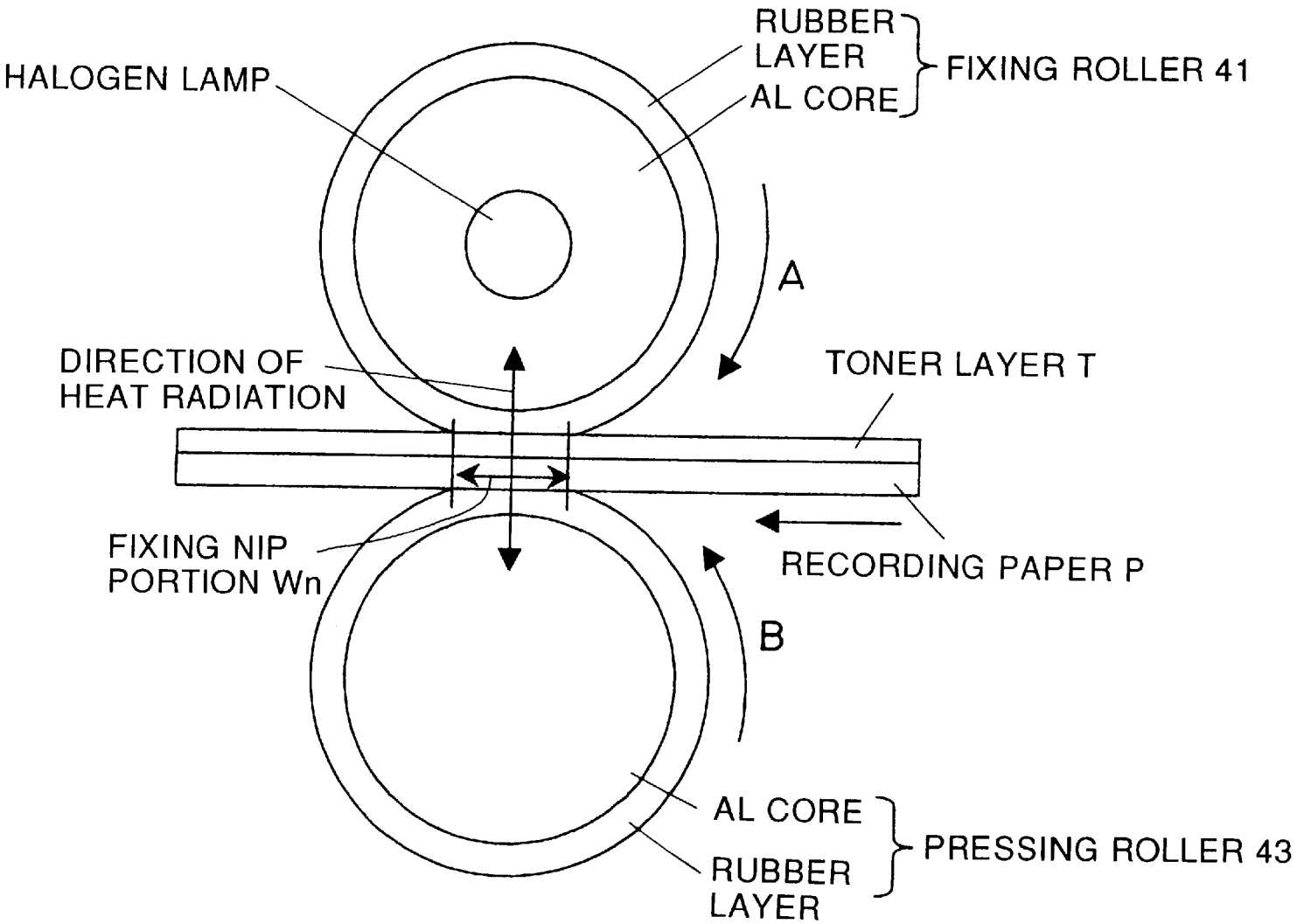
FIG. 4 is a schematic view illustrating one-dimensional heat transfer model in the fixing device shown in FIG. 1.

FIG. 4 shows one-dimensional heat transfer model of the fixing nip portion Wn for performing a theoretical thermal analysis by making use of a heat transfer simulation of the fixable region. By making use of a differential calculus from this model, a non-steady numerical analysis of the temperatures of the fixing roller 41, the pressing roller 43, the toner T and the recording paper P was performed. First of all, the heat transfer simulation of the fixing nip portion Wn by way of theoretical calculation will be explained.

The one-dimensional non-steady heat transfer formula can be represented by the following formula 1.

$$\frac{\partial T}{\partial t} = \frac{\lambda}{\rho c}\frac{\partial^2 T}{\partial x^2} \qquad \text{(formula 1)}$$

wherein T denotes temperature; t denotes time; x denotes distance; λ denotes heat conductivity; ρ denotes specific gravity; and c denotes specific heat.

Therefore, the difference formula after a spatial discretization can be represented by the following formula 2.

$$T(x, t+\tau) = T(x, t) + \frac{\lambda\tau}{\rho c h^2}[(T(x-h, t) - T(x, t)) + (T(x+h, t) - T(x, t))] \qquad \text{(formula 2)}$$

wherein h denotes lattice spacing; and τ denotes micro-time.

Therefore, if the temperatures of three lattice points, x−h, x and x+h which neighbor with each other and are spaced away by a micro-distance h at the time t are known, the temperatures T(x, t+τ) after the micro-time τ can be determined from the aforementioned formula 2.

On the other hand, the formula 2 is a difference formula within the same substance. The difference formula on the limit where different substances "a" and "b" are contacted with each other can be represented by the following formula 3.

$$T(x, t+\tau) = T(x, t) + \frac{2\tau}{\rho_a c_a h_a + \rho_b c_b h_b}\left[\frac{\lambda_a}{h_a}(T(x-h, t) - T(x, t)) + \frac{\lambda_b}{h_b}(T(x+h, t)T(x, t))\right] \qquad \text{(formula 3)}$$

The conditions for the analysis are: (1) the transfer of heat in the axial direction and circumferential direction is disregarded, and only the one-dimensional heat transfer in the thickness-wise direction (radial direction) is taken into account; (2) the temperature dependency of physical value is taken into account in the recording paper and air; (3) the toner layer is uniform in thickness, and no change in thickness thereof will take place by the fixing thereof; (4) a latent heat (heat of fusion) due to a change in phase of the toner is taken into account; (5) with respect to a change in physical value due to a change in phase of the toner, only the heat conductivity is taken into account; (6) the contact heat resistance is not taken into account; and (7) the evaporation heat of water from the recording paper is taken into account.

Among these conditions, experiments on the conditions of: (2) the temperature dependency of physical value is taken into account in the recording paper; and (7) the evaporation heat of water from the recording paper is taken into account were performed as follows.

Figure 5:
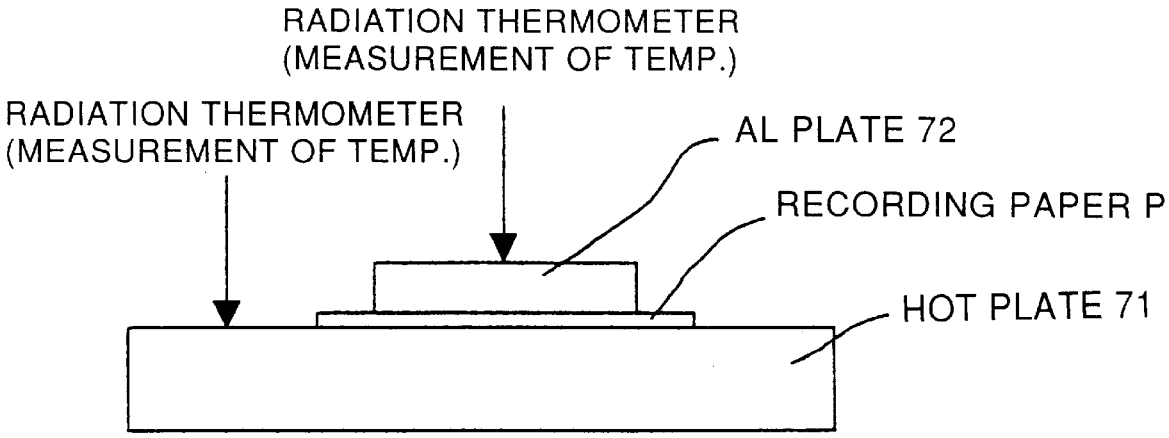
FIG. 5 is a schematic view of an experimental device employed for determining the relationship between the temperature of recording paper and the heat conductivity of the recording paper.
Figure 6:
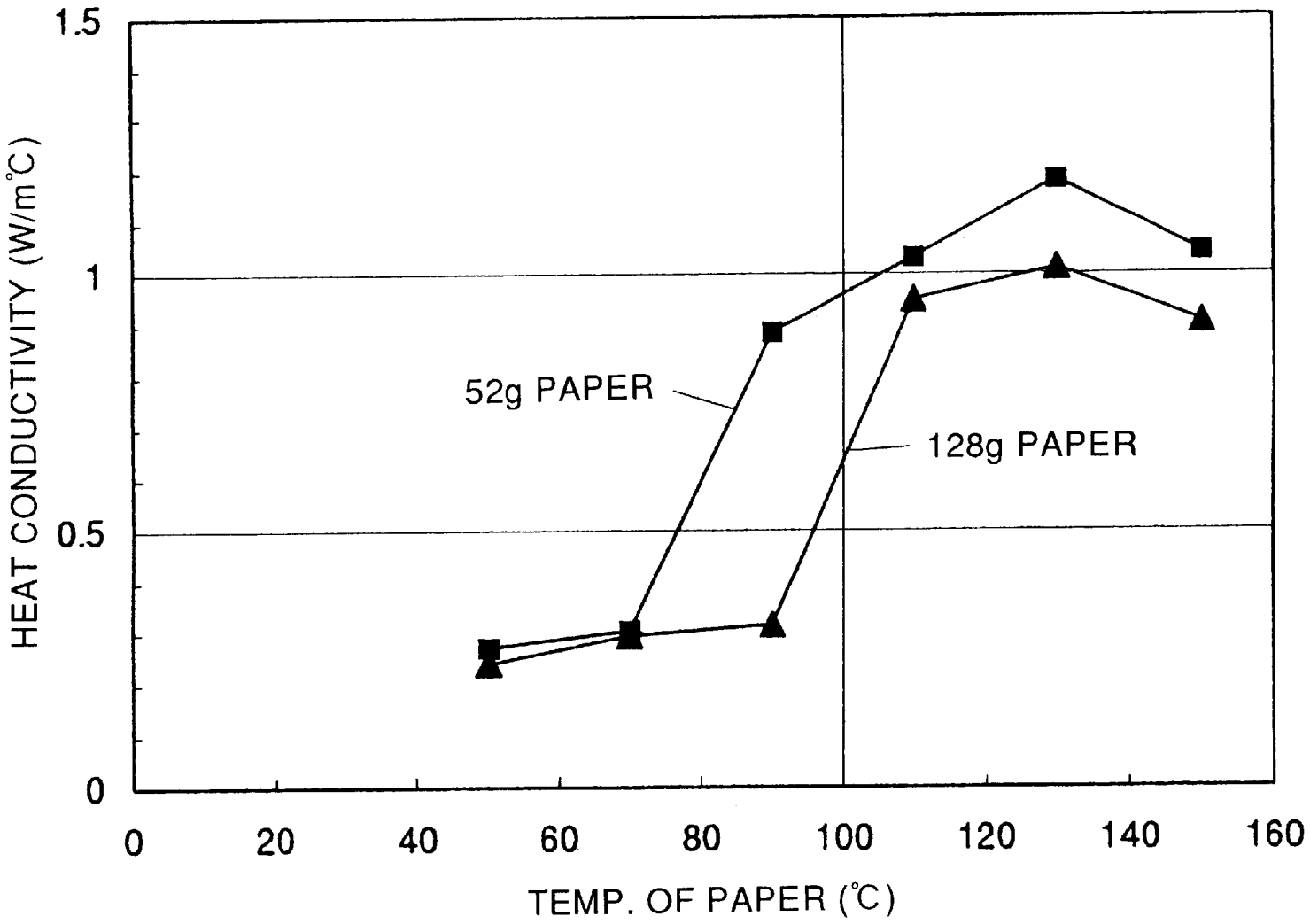
FIG. 6 is a diagram illustrating the results of experiment obtained from the device shown in FIG. 5.

FIG. 5 shows an experimental device employed for determining the relationship between the temperature of recording paper and the heat conductivity of the recording paper, and FIG. 6 shows the results measured and calculated in the experiment.

The experiment was performed as follows. Namely, a recording paper P and an aluminum plate 72 were successively laminated on the surface of a hot plate 71. After the hot plate 71 was heated to a predetermined temperature, the temperature $T_1$ of the hot plate as well as the temperature $T_0$ of the aluminum plate under the normal condition were respectively measured by making use of a radiation thermometer (not shown). Additionally, the temperature $T_1'$ of the hot plate as well as the temperature $T_0'$ of the aluminum plate were respectively measured under the condition where the recording paper P was not laminated.

At this moment, the heat conductivity $\lambda_p$ of the recording paper P can be represented by the following formula 4.

$$\lambda_p = \frac{t_p(T_1' - T_0')}{(T_1 - T_1')\left(\frac{t_a}{\lambda_a} + R_c\right)} \qquad \text{(formula 4)}$$

wherein $t_p$ is a thickness of recording paper; $t_a$ is a thickness of the aluminum plate; $\lambda_a$ is a heat conductivity of aluminum; and $R_c$ is a contact heat resistance between the aluminum plate and the hot plate.

It will be seen that, when the temperature was raised 100° C. or more, the heat conductivity $\lambda_p$ of the recording paper P was increased, irrespective of the thickness of paper, by about four times as that of about 50° C. (see FIG. 6).

This phenomenon is deemed to be attributed to the evaporation of water from the recording paper P, and hence, the heat conductivity $\lambda_p$ of the recording paper P should be treated as being changeable depending on temperature. Under the circumstances, the aforementioned analysis conditions (2) and (7) are adopted.

By measuring the temperature of atmosphere immediately before the recording paper P is introduced into the fixing nip portion Wn by making use of the aforementioned simulation, and by performing the calculation after introducing predetermined values of the fixing roller 41, the pressing roller 43, the toner T, etc. and setting the time t=0 as an initial condition, the changes in temperature at each portion after an optional time t can be determined. In the above experiment, the fixing speed was set to 85 mm/sec, and the fixing nip width was set to 4 mm, and hence, the temperature of each portion after the lapse of time $\tau=4/85=$ 47 msec. was calculated according to the above formula.

Figure 7:
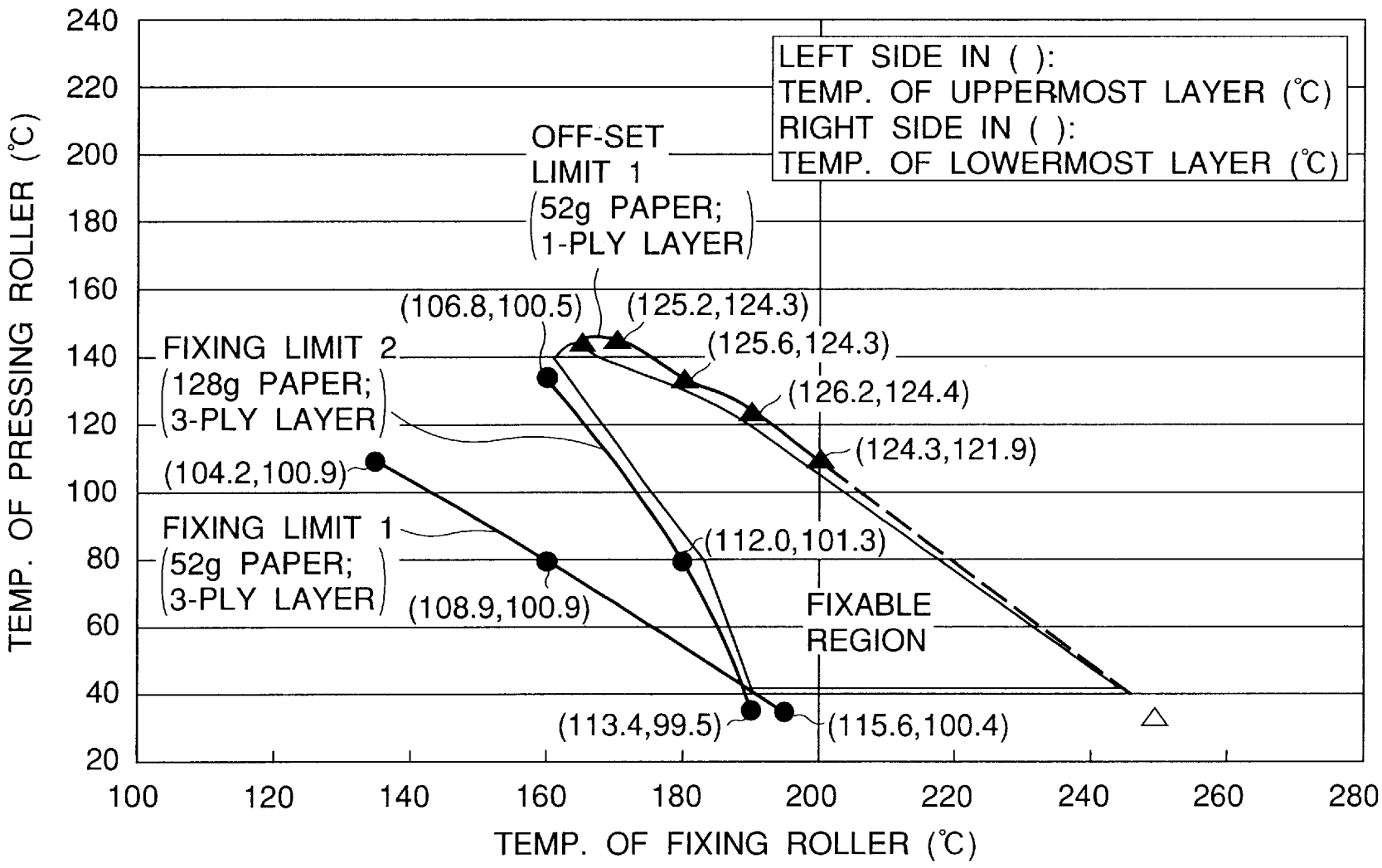
FIG. 7 is a diagram illustrating the result of simulation on the temperature of toner in each limiting line.

FIG. 7 shows the result of simulation on the temperatures of the uppermost layer and the lowermost layer of the toner layer at the outlet portion of the fixing nip portion Wn in each limiting line.

As seen from this result, since the limiting line for fixing (the fixing limit 1 of a 52 g paper and the fixing limit 2 of a 128 g paper) is located such that the temperature of the lowermost layer of toner (indicated in FIG. 7 by a value on the right side in the bracket) is around 100° C. in every cases, it is possible, irrespective of the kind of paper, to obtain a sufficient fixing strength as long as the temperature of the lowermost layer of toner is 100° C. or more. When a toner whose softening temperature is 97° C. is to be employed as in the case of the above experiment, the temperature of the toner is required to be raised higher than the softening temperature thereof as a condition for obtaining a sufficient fixing strength.

On the other hand, since the temperature of the uppermost layer of toner (indicated in FIG. 7 by a value on the left side in the bracket) at the limiting line where a high temperature off-set phenomenon would not be generated (the off-set limit 1) is around 125° C. in every cases, it is possible, under the critical temperature for usage of the fixing roller 41, to prevent the generation of high temperature off-set phenomenon irrespective of the kind of paper, as long as the temperature of the uppermost layer of toner is 125° C. or less.

It will be also understood that on the fixing limiting line (fixing limit 1 and fixing limit 2), the temperature of the lowermost layer of toner is kept constant at about 100° C., whereas as the temperature of the pressing roller 43 is decreased, the temperature of the uppermost layer of toner becomes higher. Further, as the temperature of the uppermost layer of toner becomes higher, the surface of toner can be more easily melted and flattened. This phenomenon agrees with the results of above experiment wherein the grossness G was increasingly enhanced as the temperature of the pressing roller 43 was lowered (see FIG. 3).

As explained above, the fixing strength and the high temperature off-set phenomenon are affected both depending on the temperature of toner at the outlet portion of the fixing nip portion Wn. Namely, since the fixing strength can be directly determined by the temperature of the lowermost layer of toner, while the high temperature off-set phenomenon can be directly determined by the temperature of the uppermost layer of toner, the fixable region can be expected from the aforementioned heat transfer simulation.

Figure 8:
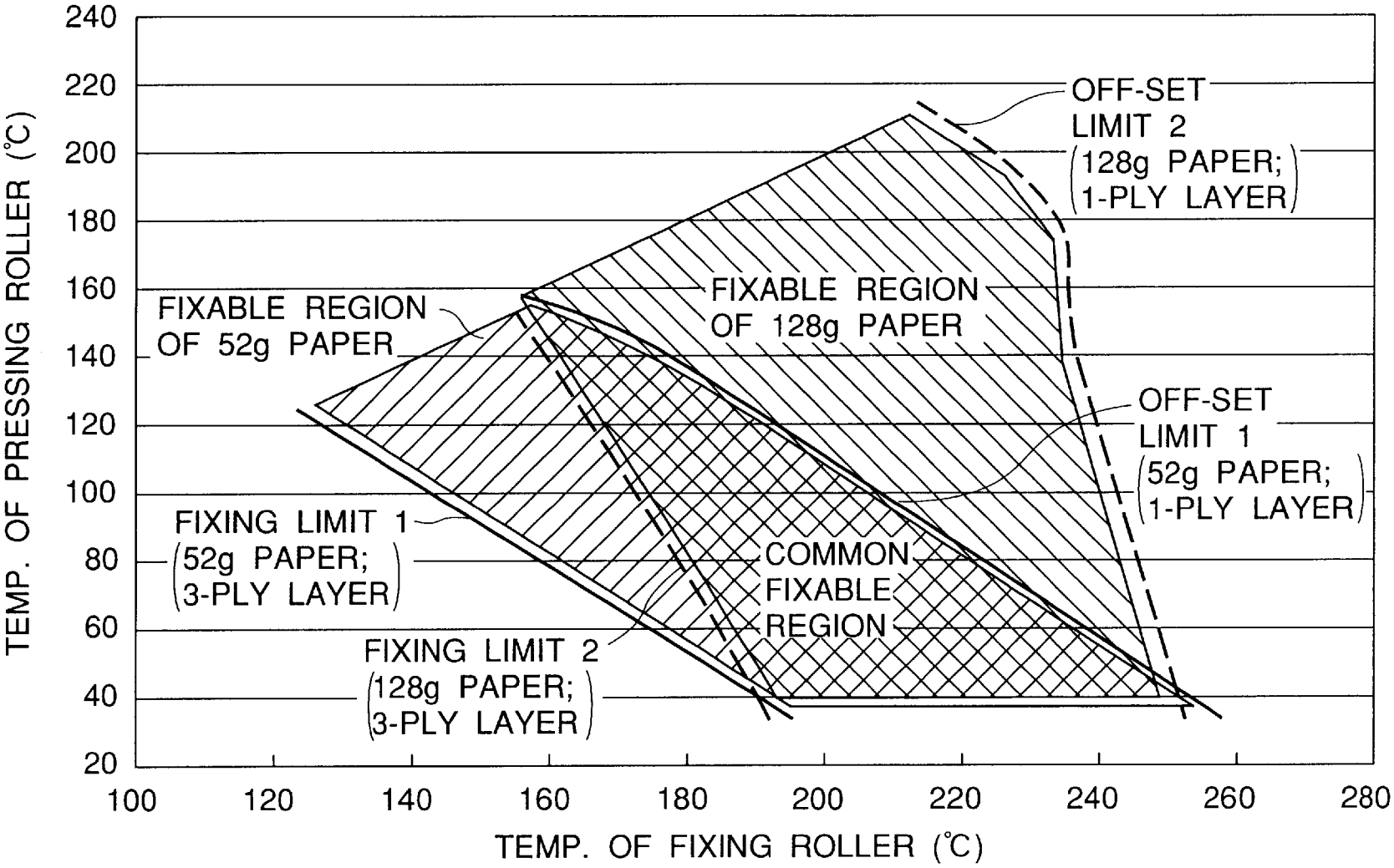
FIG. 8 is a diagram illustrating the result of simulation on the fixable region in a thick paper and a thin paper.

FIG. 8 shows the result of the aforementioned heat transfer simulation wherein the fixable region for each of a thin paper (paper of 52 g/m$^2$) and a thick paper (paper of 128 g/m$^2$) was expected.

It will be seen from FIG. 8 that as the temperature of the pressing roller 43 is lowered, the fixable region of thin paper (indicated in FIG. 8 by slanting lines inclined leftward) is increasingly overlapped with the fixable region of thick paper (indicated in FIG. 8 by slanting lines inclined rightward), thus expanding the common fixable region thereof.

Figure 9:
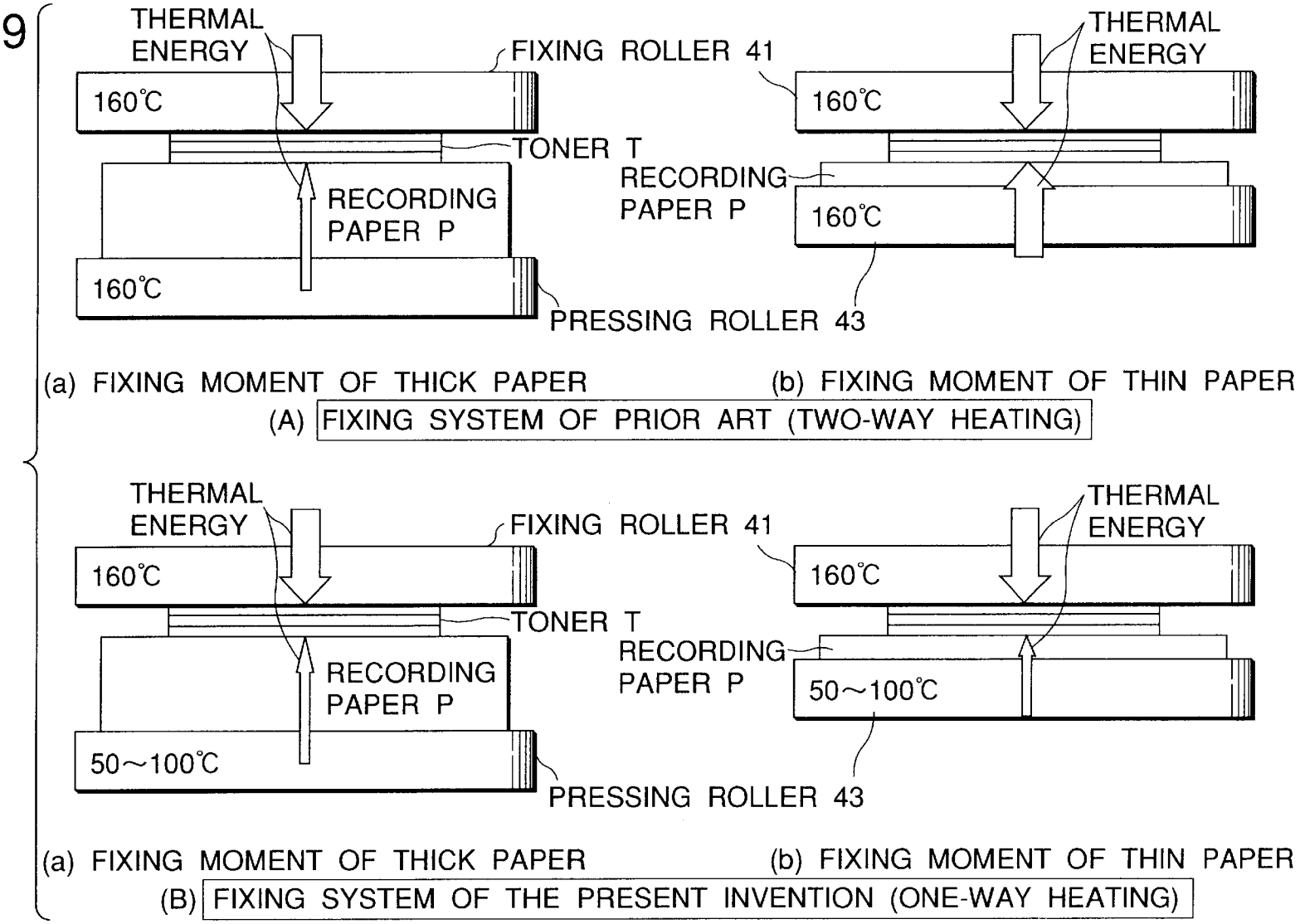
FIG. 9 is a schematic view illustrating the model of one-way heat fixing method.

FIG. 9 illustrates, by way of a model, this phenomenon of expanding the common fixable region.

According to the conventional two-way heat fixing method shown in FIG. 9(A), since the fixing roller 41 is directly contacted with the toner T, the quantity of thermal energy (the magnitude thereof is indicated by the arrow in FIG. 9) to be supplied from the fixing roller 41 to the toner T is not caused to change so much depending on the kind (thickness) of the recording paper. However, since the quantity of thermal energy (the magnitude thereof is indicated by the arrow in FIG. 9) to be supplied from the pressing roller 43 to the toner T is supplied through the recording paper P, the magnitude of the thermal energy is much influenced depending on the kind, thickness, basis weight, heat conductivity, etc. of the recording paper P.

Therefore, even if the temperature of the pressing roller 43 is high, the magnitude of thermal energy that can be transferred to the toner T from the pressing roller 43 is relatively small when a thick paper is employed (FIG. 9(*a*)), whereas in the case of thin paper, the magnitude of thermal energy that can be transferred to the toner T is large (FIG. 9(*b*)). Namely, the fixable region is greatly affected by the kind of recording paper, thus making it difficult to set a common fixable region.

By contrast, according to the one-way heat fixing method representing the fixing method of the present invention shown in FIG. 9(B), since the temperature of the pressing roller 43 can be lowered, the magnitude of thermal energy that can be transferred to the toner T from the pressing roller 43 is relatively small irrespective of the kind of recording paper, i.e. either a thick paper or a thin paper (FIG. 9(*a*) and (*b*)). Therefore, the fusion and fixing of the toner T are effected only through the thermal energy to be supplied from the fixing roller 41, thereby assumably assuring the common fixable region as shown in FIG. 8.

As explained above, it becomes possible, through the employment of the one-way heat fixing method wherein thermal energy is supplied only through the fixing roller 41, to secure a wider fixable region which is common to both kinds of recording paper as compared with the conventional two-way heat fixing method wherein thermal energy is supplied from both fixing roller 41 and pressing roller 43. Therefore, in the fixing process using a color toner, the quantity of oil can be reduced to such a degree that the surface of the fixing roller 41 is simply impregnated with the oil. As a result, the consumption of oil can be reduced, and at the same time, the fixing strength can be improved and the generation of high temperature off-set phenomenon can be prevented. Even in the fixing process using a monochrome toner, without any requirement of the addition of a wax to the toner, the fixing strength can be improved and the generation of high temperature off-set phenomenon can be prevented.

In the following paragraphs, the degree of suppression of the thermal energy to be supplied from the pressing roller 43, which is effective in obtaining a sufficient effect of the one-way heat fixing method has been studied.

Figure 10:
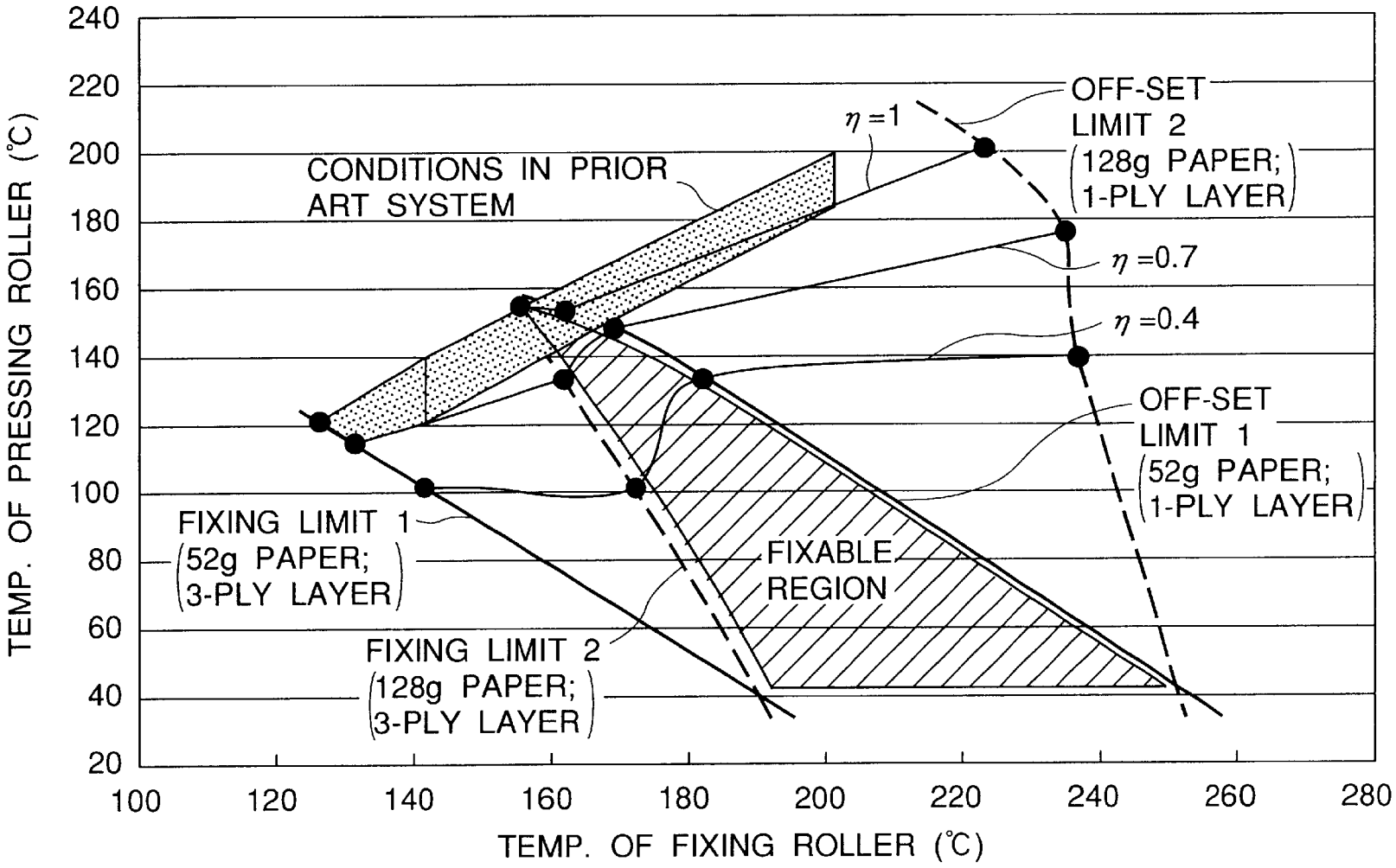
FIG. 10 is a diagram illustrating the results of simulation conducted on the fixable region and the ratio of thermal energy $\eta$ where the dual time is set to 47 msec.
Figure 11:
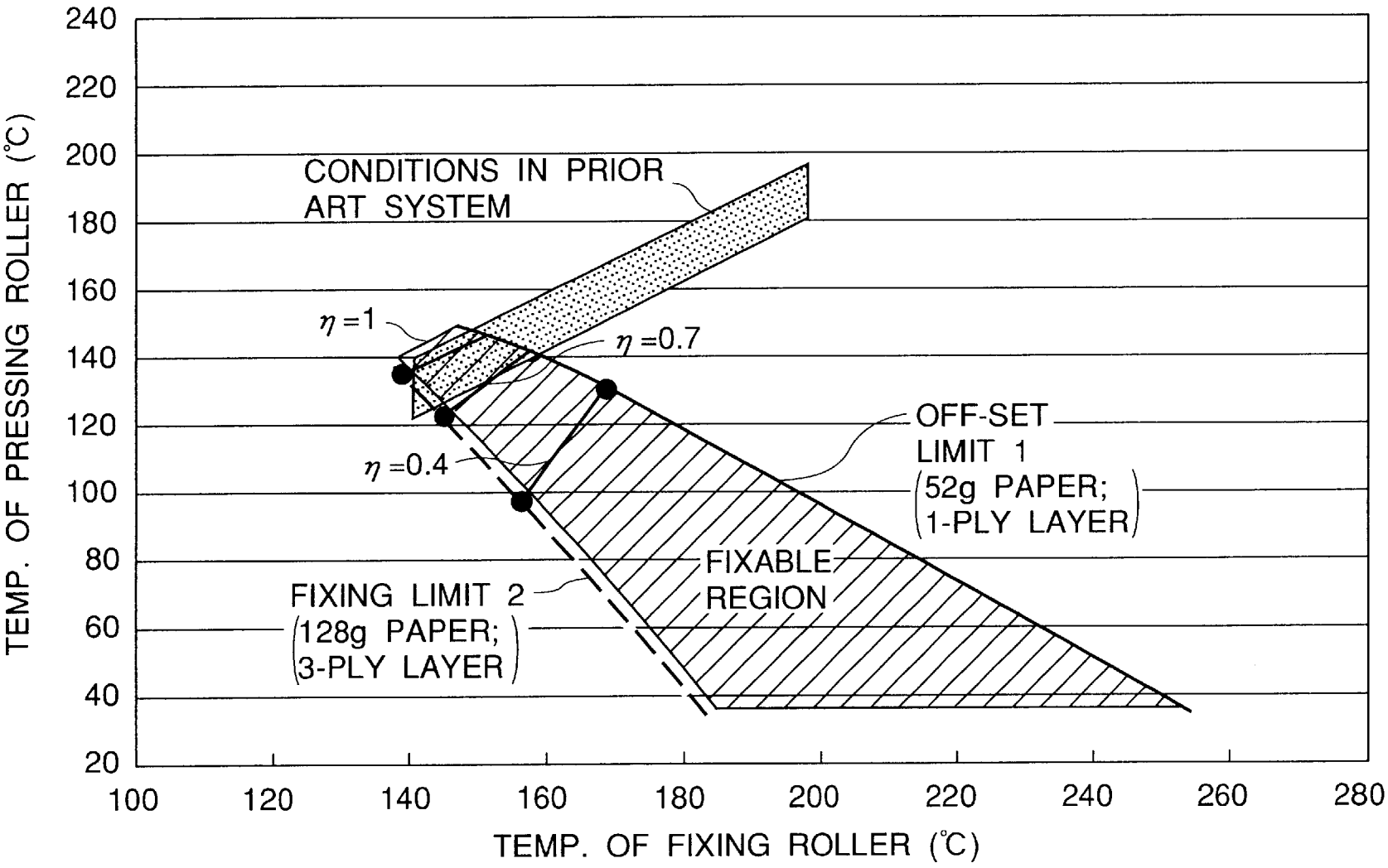
FIG. 11 is a diagram illustrating the results of simulation conducted on the fixable region and the ratio of thermal energy $\eta$ where the dual time is set to 70.5 msec.
Figure 12:
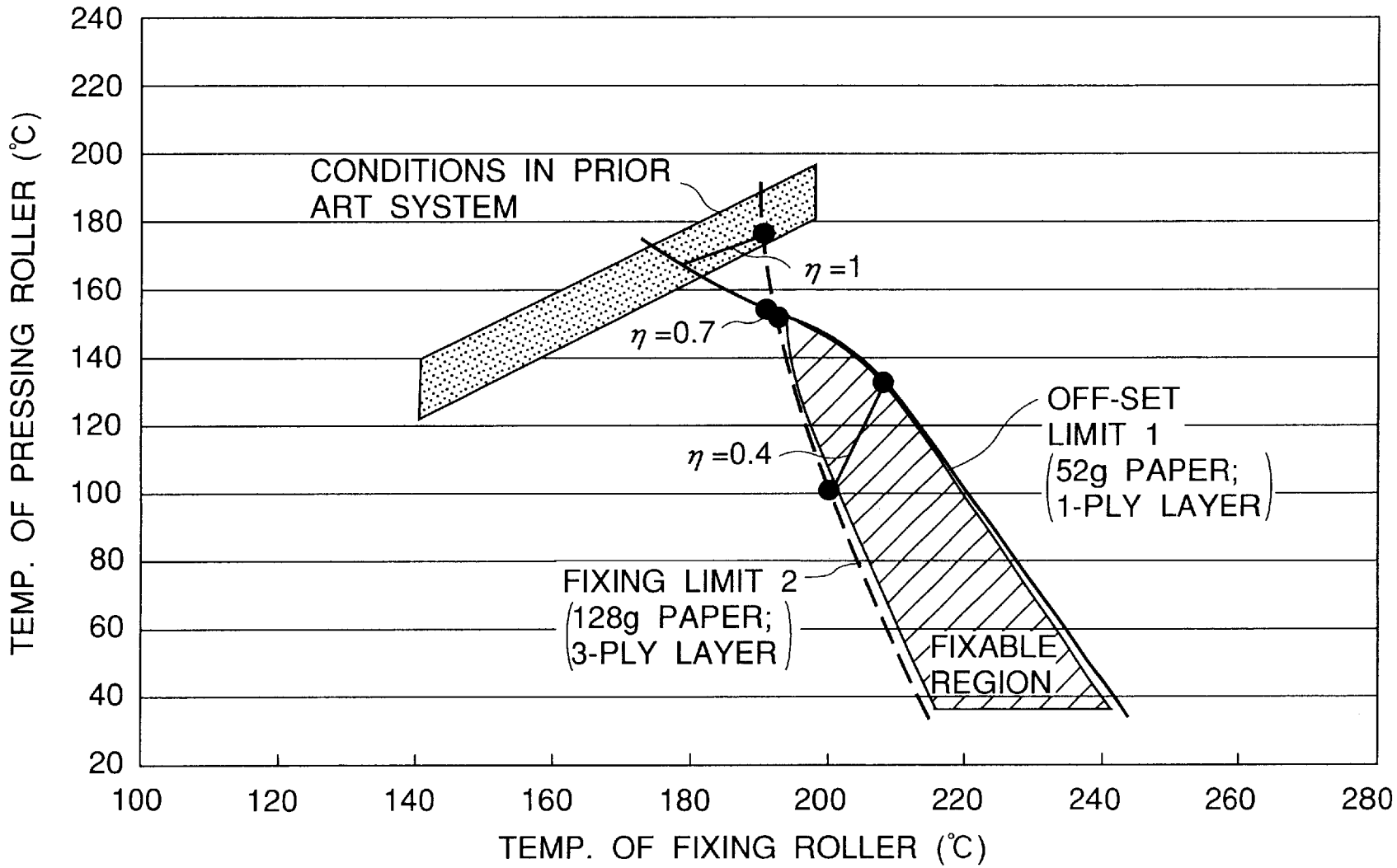
FIG. 12 is a diagram illustrating the results of simulation conducted on the fixable region and the ratio of thermal energy $\eta$ where the dual time is set to 23.5 msec.

In this case, since it is difficult to experimentally measure the quantity of thermal energy to be supplied from the fixing roller 41 and pressing roller 43 to the toner T and to the recording paper P, the quantity of thermal energy was calculated by making use of the aforementioned simulation, i.e. by making use of each temperature of the toner T, recording paper P, fixing roller 41 and pressing roller 43 immediately before the fixing is performed. The results are shown in FIGS. 10 to 12.

First of all, the time required for a specific portion of the recording paper P (or the toner layer) to pass through the fixing nip portion Wn, i.e. so-called dual time Td can be represented by the following formula 5.

$$Td=Wn/Vp \quad \text{(formula 5)}$$

wherein Wn is the fixing nip portion; and Vp is the traveling speed of the recording paper P.

The quantity of thermal energy was calculated on three cases: Td=47 msec. (FIG. 10); Td=70.5 msec. (FIG. 11); and Td=23.5 msec. (FIG. 12).

Herein, the η in these FIGS. denotes a ratio in magnitude of thermal energy between a magnitude of thermal energy (Qh) to be fed from the fixing roller 41 to the toner T and the recording paper P, and a magnitude of thermal energy (Qp) to be fed from the pressing roller 43 to the toner T and the recording paper P. This η can be represented by the following formula 6.

$$\eta=Qp/Qh \quad \text{(formula 6)}$$

It will be seen that the fixable region according to this embodiment (indicated by slanted lines in FIGS.) where the dual time Td is set to 47 msec. (FIG. 10) or to 70.5 msec. (FIG. 11) overlaps with the employment condition of the conventional system (indicated by a dot pattern in FIGS.) only when this η is confined to the range of $0.7<\eta<1$. Therefore, in order to obtain a wider fixable region than that of the conventional system, the η should be set to $\eta\leqq 0.7$.

On the other hand, the fixable region where the dual time Td is set to 23.5 msec. (FIG. 12) (indicated by slanted lines in FIGS.) does not overlap with the employment condition of the conventional system (indicated by a dot pattern in FIGS.), and the fixable region according this embodiment can be generated even if η is 0.7 or less. Therefore, the condition for obtaining a fixable region should be such that the η is confined to $\eta\leqq 0.7$.

Therefore, it will be seen from the formula 6 and FIGS. 10 to 12 that when the condition of: $\eta=Qp/Qh\leqq 0.7$ is satisfied, the fixable region can be secured in the one-way heat fixing method.

Next, the critical temperature for usage of the fixing roller 41 will be examined.

Even if the temperature of the pressing roller 43 is relatively low, the temperature of the fixing roller 41 is required to be raised in order to secure the effect of the fixable region (see FIG. 3). Therefore, the temperature of the fixing roller 41 according to the one-way heat fixing method is required to be set higher than that of the two-way heat fixing method.

However, since the fixing roller 41 of the fixing device 40, in particular, the fixing roller 41 of the color toner fixing device is usually constructed such that the covering material thereof is formed of a rubber material, so that the critical temperature for usage thereof is required to be set to as low as about 200° C. On the other hand, as seen from the comparison among FIGS. 10 to 12, the longer the dual time is, the larger is the shifting distance of the fixable region toward the lower temperature side of the fixing roller 41.

Therefore, in order to expand the fixable region in the employment of the one-way heat fixing method, the dual time Td is required to be extended.

Namely, as seen from FIGS. 10 to 12, when the critical temperature for usage of the fixing roller 41 is taken into account, the effect of the fixable region by the employment of the one-way heat fixing method can be obtained when the dual time Td is set to 47 msec. or more.

Figure 13:
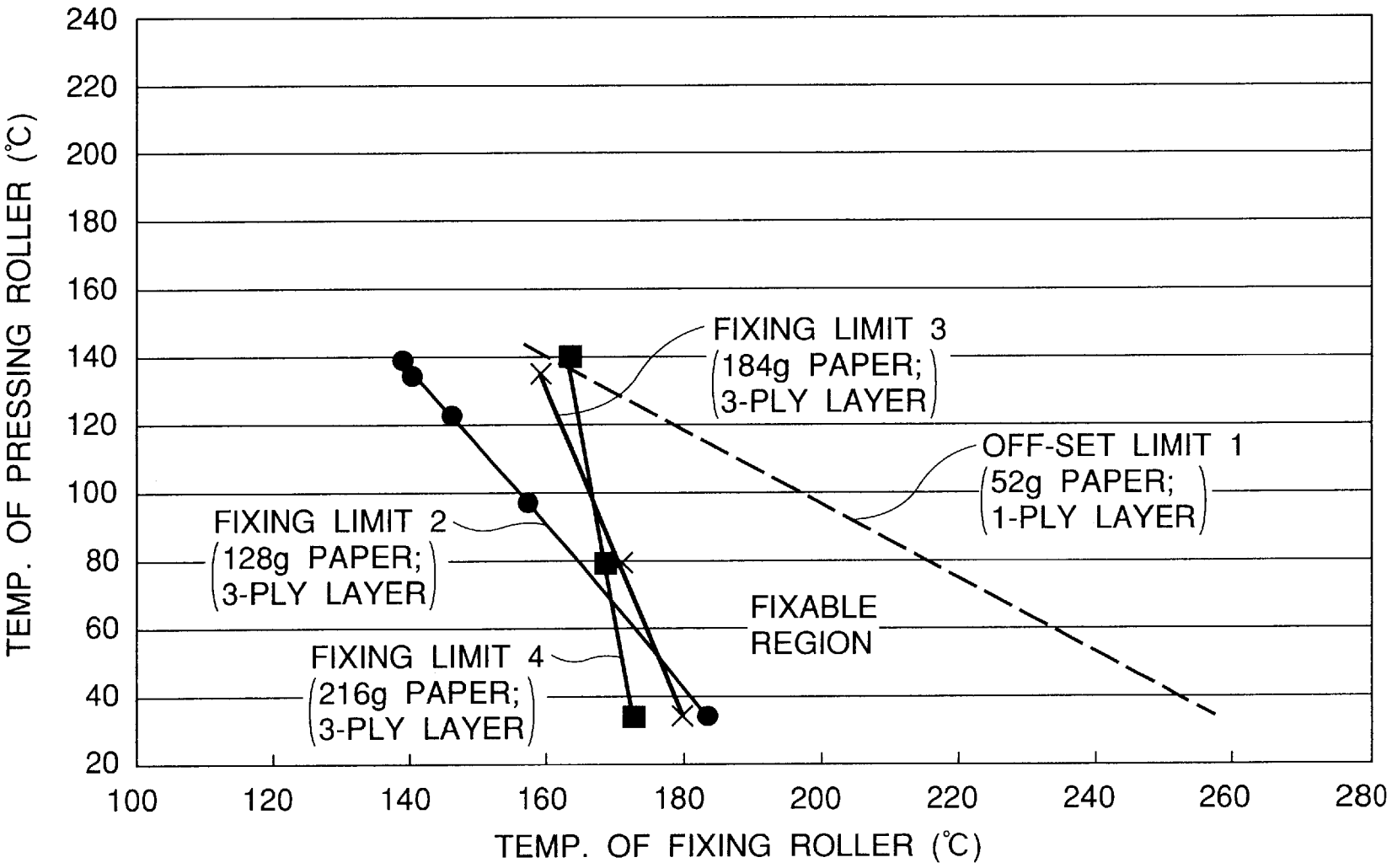
FIG. 13 is a diagram illustrating the result of simulation on the fixable region in another thin paper.

FIG. 13 shows the result of the one-way heat fixing method when the method was applied to a thick paper having a basis weight of 184 g/m$^2$ (fixing limit 3) and to a thick paper having a basis weight of 216 g/m$^2$ (fixing limit 4).

It will be seen from the results of this experiment that when a thick paper having a basis weight of 184 g/m$^2$ or more (fixing limit 3) is employed, the inclination (absolute value) of the fixing limit becomes more prominent in proportion to the increase of the basis weight of the paper, so that the fixing limit line of the fixable region would be ultimately determined only by the temperature (about 160 to 180° C.) of the fixing roller 41, irrespective of the temperature of the pressing roller 43.

Therefore, when a paper having a basis weight of 184 g/m$^2$ or more is employed in the one-way heat fixing method, the temperature of the fixing roller 41 would not be increased up to the critical temperature for usage of the fixing roller 41, thus enabling to obtain a more excellent effect of the fixable region.

Figure 14:
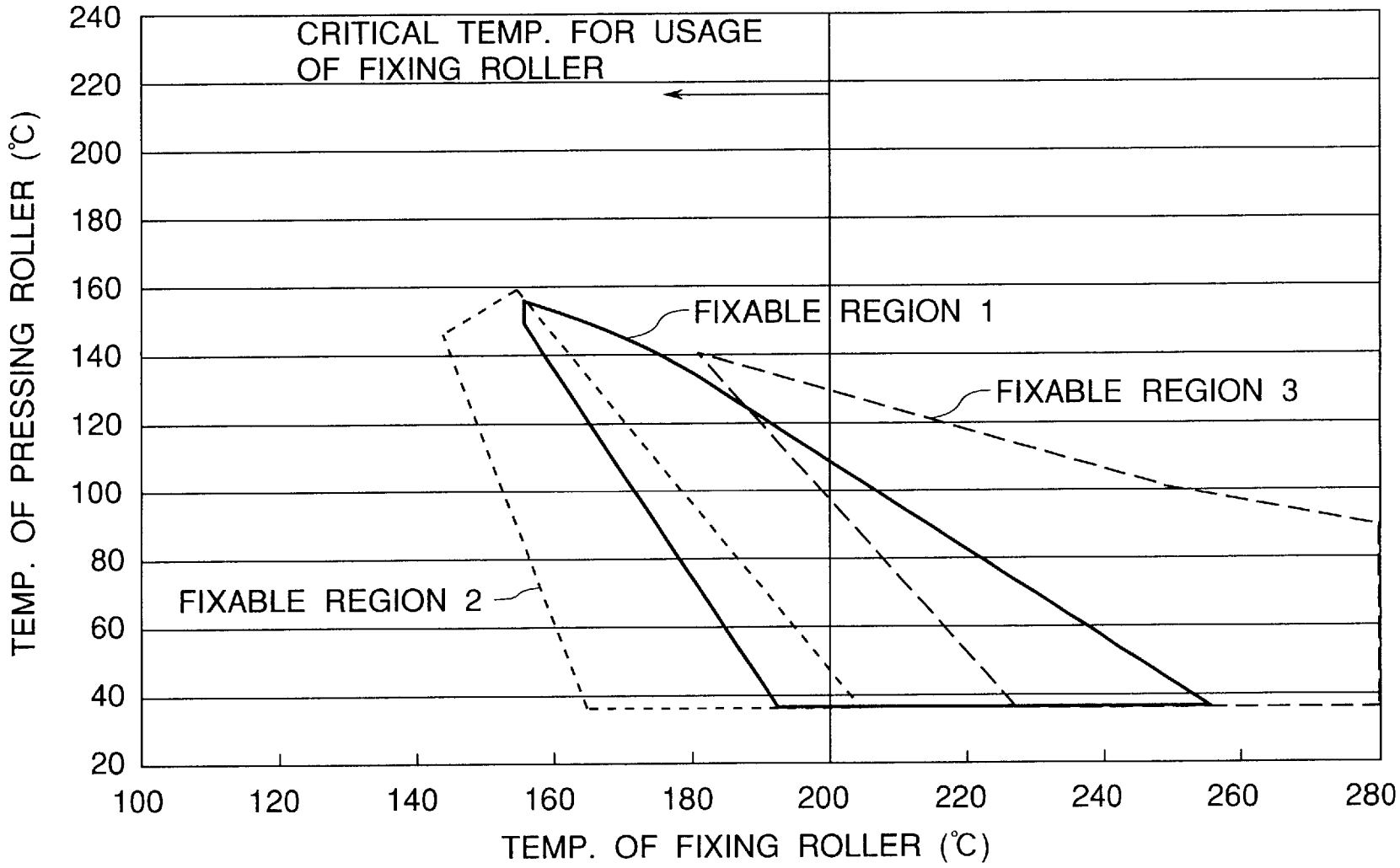
FIG. 14 is a diagram illustrating the result of simulation on the heat conductivity of the covering layers of the fixing roller and of the pressing roller, and on the fixable region.

Next, the relationship between the heat conductivity of the covering layer 41*b* of the fixing roller 41 and of the covering layer 43*b* of the pressing roller 43 and the fixable region was studied by making use of the aforementioned heat transfer simulation. Table 1 shows the conditions for the simulation, and FIG. 14 shows the results of the simulation.

TABLE 1

| | | This embodiment (fixable region 1) | | Comp. Ex. 1 (fixable region 2) | Comp. Ex. 2 (fixable region 3) |
|---|---|---|---|---|---|
| Heat conductivity λh of covering layer of fixing roller (W/m° C.) | 1st layer | HTV | 0.48 | 0.48 | 0.1 |
| | 2nd layer | fluoro-rubber | 0.21 | 0.48 | 0.1 |
| | 3rd layer | LTV | 0.21 | 0.48 | 0.1 |
| Heat conductivity λp of covering layer of pressing roller (W/m° C.) | 1st layer | LTV | 0.251 | 0.1 | 0.48 |

As shown in Table 1, the simulation was performed under the conditions of: (1) the heat conductivity λh of the covering layer 41*b* of the fixing roller 41 is approximately equal to the heat conductivity λp of the covering layer 43*b* of the pressing roller 43 (the present embodiment) (fixable region 1); (2) λh>λp (the Comparative Example 1) (fixable region 2); and (3) λh<λp (the Comparative Example 2) (fixable region 3).

As shown in FIG. 14, in the case of the Comparative Example 2 (fixable region 3), the most of the fixable region was shifted toward the high temperature side of the fixing roller 41, thereby exceeding over the critical temperature for usage (200° C.) of the fixing roller 41. By contrast, in the cases of the present embodiment (fixable region 1) and of the Comparative Example 1 (fixable region 2), the fixable region was found existing within the critical temperature for usage (200° C.) of the fixing roller 41.

Therefore, it will be seen that in the case of the one-way heat fixing method, the relationship between the heat conductivity λh of the covering layer 41*b* of the fixing roller 41 and the heat conductivity λp of the covering layer 43*b* of the pressing roller 43 should preferably be set to λh≧λp.

Furthermore, the relationship between the ratio in magnitude of thermal energy η (=Qp/Qh) and the magnitude of thermal energy Qh and Qp to be fed from the fixing roller 41 and pressing roller 43 to the toner T and the recording paper P was studied by making use of the aforementioned heat transfer simulation. Tables 2, 3 and 4 show the results of the study, wherein Table 2 shows the magnitude of thermal energy when the dual time Td was set to 23.5 msec.; Table 3 shows the magnitude of thermal energy when the dual time Td was set to 47 msec.; and Table 4 shows the magnitude of thermal energy when the dual time Td was set to 70.5 msec.

This study was performed with respect to the fixing limit 2 indicating the fixable region and to the off-set limit 1. In this case, the magnitude of thermal energy Qh means a quantity of thermal energy to be supplied to the toner T from the fixing roller 41 and also from the pressing roller 43 in performing the fixing of toner T per A4 size recording paper P, while the magnitude of thermal energy Qp means a quantity of thermal energy to be supplied to the recording paper P from the fixing roller 41 and also from the pressing roller 43 in performing the fixing of toner T per A4 size recording paper P. These thermal energies are summed to obtain a total quantity of thermal energy Q (Q=Qh+Qp), thus determining the power consumption of the fixing device 40 of this embodiment.

TABLE 2

| | Thermal energy | η = 1 | η = 0.7 | η = 0.4 | η ≈ 0 |
|---|---|---|---|---|---|
| Fixing limit 2 | Qh (J/A4) | 1100 | 1114 | 1136 | 1286 |
| (128 g paper; 3-ply layer) | Qp (J/A4) | 1072 | 772 | 458 | 0 |
| | Q (J/A4) | 2172 | 1886 | 1594 | 1286 |
| Off-set limit 1 | Qh (J/A4) | 826 | 957 | 1136 | 1352 |
| (52 g paper; 1-ply layer) | Qp (J/A4) | 835 | 677 | 458 | 0 |
| | Q (J/A4) | 1661 | 1634 | 1594 | 1352 |

TABLE 3

| | Thermal energy | η = 1 | η = 0.7 | η = 0.4 | η ≈ 0 |
|---|---|---|---|---|---|
| Fixing limit 2 | Qh (J/A4) | 1078 | 1146 | 1292 | 1515 |
| (128 g paper; 3-ply layer) | Qp (J/A4) | 1015 | 815 | 512 | 0 |
| | Q (J/A4) | 2093 | 1961 | 1804 | 1515 |
| Off-set limit 1 | Qh (J/A4) | 841 | 961 | 1179 | 1611 |
| (52 g paper; 1-ply layer) | Qp (J/A4) | 843 | 711 | 473 | 0 |
| | Q (J/A4) | 1684 | 1672 | 1652 | 1611 |

TABLE 4

| | Thermal energy | η = 1 | η = 0.7 | η = 0.4 | η ≈ 0 |
|---|---|---|---|---|---|
| Fixing limit 2 | Qh (J/A4) | 1044 | 1148 | 1240 | 1642 |
| (128 g paper; 3-ply layer) | Qp (J/A4) | 1004 | 806 | 511 | 0 |
| | Q (J/A4) | 2048 | 1954 | 1751 | 1642 |
| Off-set limit 1 | Qh (J/A4) | 839 | 989 | 1209 | 1640 |
| (52 g paper; 1-ply layer) | Qp (J/A4) | 850 | 693 | 460 | 0 |
| | Q (J/A4) | 1689 | 1682 | 1669 | 1640 |

As seen from these results, the total quantity of thermal energy Q can be reduced in proportion to a decrease in magnitude of the thermal energy ratio η irrespective of the dual time Td. As described above, according to the one-way heat fixing method of this embodiment where the thermal energy ratio η is: η≦0.7, it is possible to minimize the magnitude of thermal energy to be supplied to the toner T and the recording paper P as compared with the two-way heat fixing method, thereby making it possible to reduce the power consumption.

By the way, even if this thermal energy ratio η becomes the same, the total quantity of thermal energy Q also becomes the same irrespective of the dual time Td, so that it will be clear that there is not any particular optimal value with respect to the dual time Td relative to the magnitude of thermal energy to be supplied to the toner T and the recording paper P.

The following paragraphs are the explanation of the study made on the grossness to be obtained in the one-way heat fixing method.

As shown in FIG. 7, since a difference in temperature between layers of toner, i.e. a difference in temperature between the uppermost layer and the lowermost layer of the toner becomes large in the one-way heat fixing method, it is possible to obtain an image having a higher grossness as compared with that obtainable in the two-way heat fixing method (see FIGS. 3 and 7).

Figure 15:
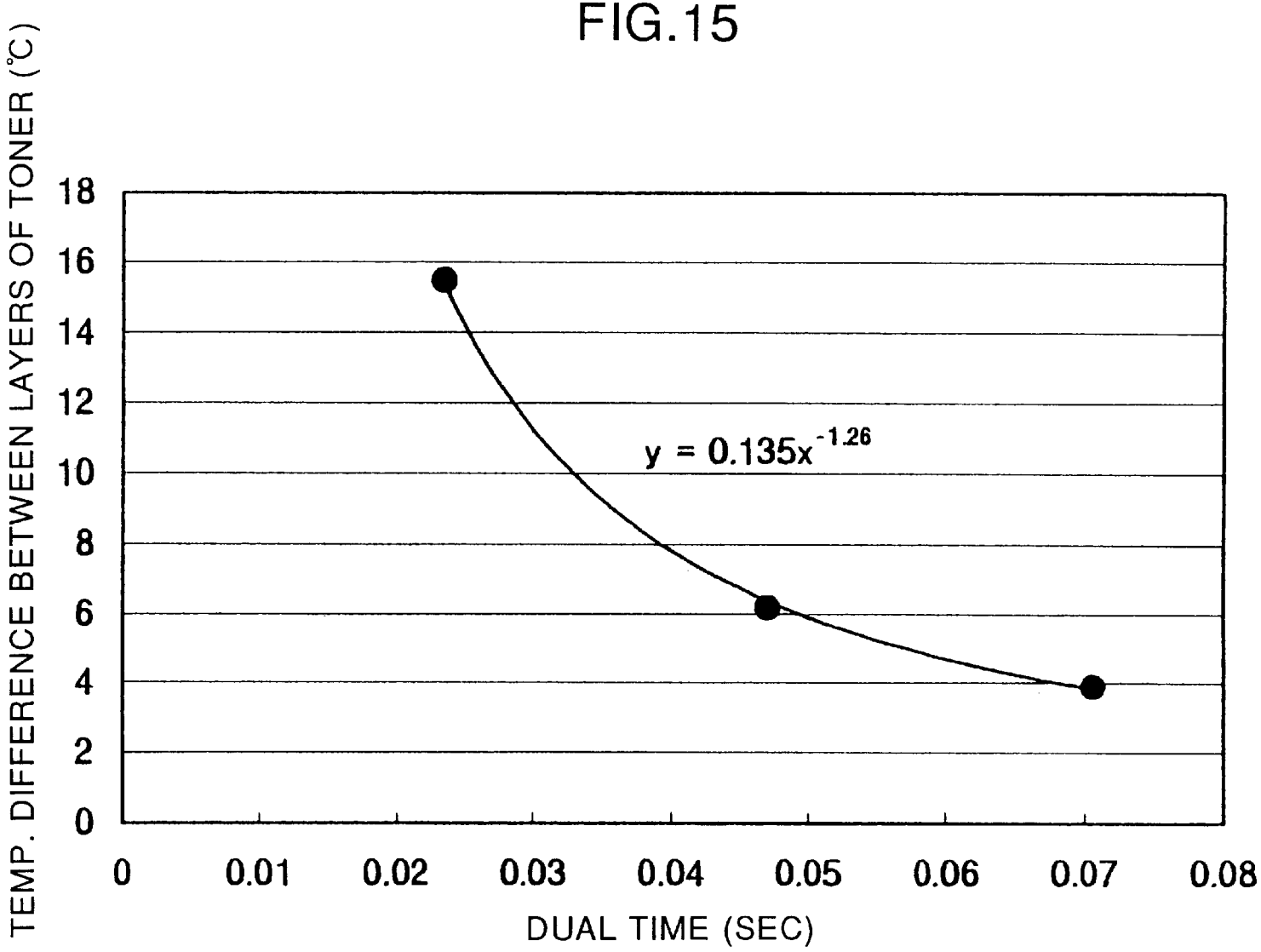
FIG. 15 is a diagram illustrating the result of simulation on t he relationship between a difference in temperature between toner layers and the dual time.

In this case, the relationship between a difference in temperature Δt between the layers of toner in a 3-ply toner (fixing limit 2) of a 128 g paper and the dual time Td was determined under the condition where the thermal energy ratio was set to:η=0.7 by making use of the aforementioned heat transfer simulation, the results being shown in FIG. 15.

As seen from the results, the difference in temperature Δt(° C.) between the layers of toner can be approximately expressed by the following formula 7.

$$\Delta t \geqq 0.135\ (Wn/Vp)^{-1.26} \qquad \text{(formula 7)}$$

wherein Td is a dual time (sec.).

Therefore, it will be seen that if the temperature difference Δt(° C.) between the layers of toner is larger than 0.135 $(Wn/Vp)^{-1.26}$, it becomes possible to improve the grossness of image by making use of the one-way heat fixing method.

Figure 16:
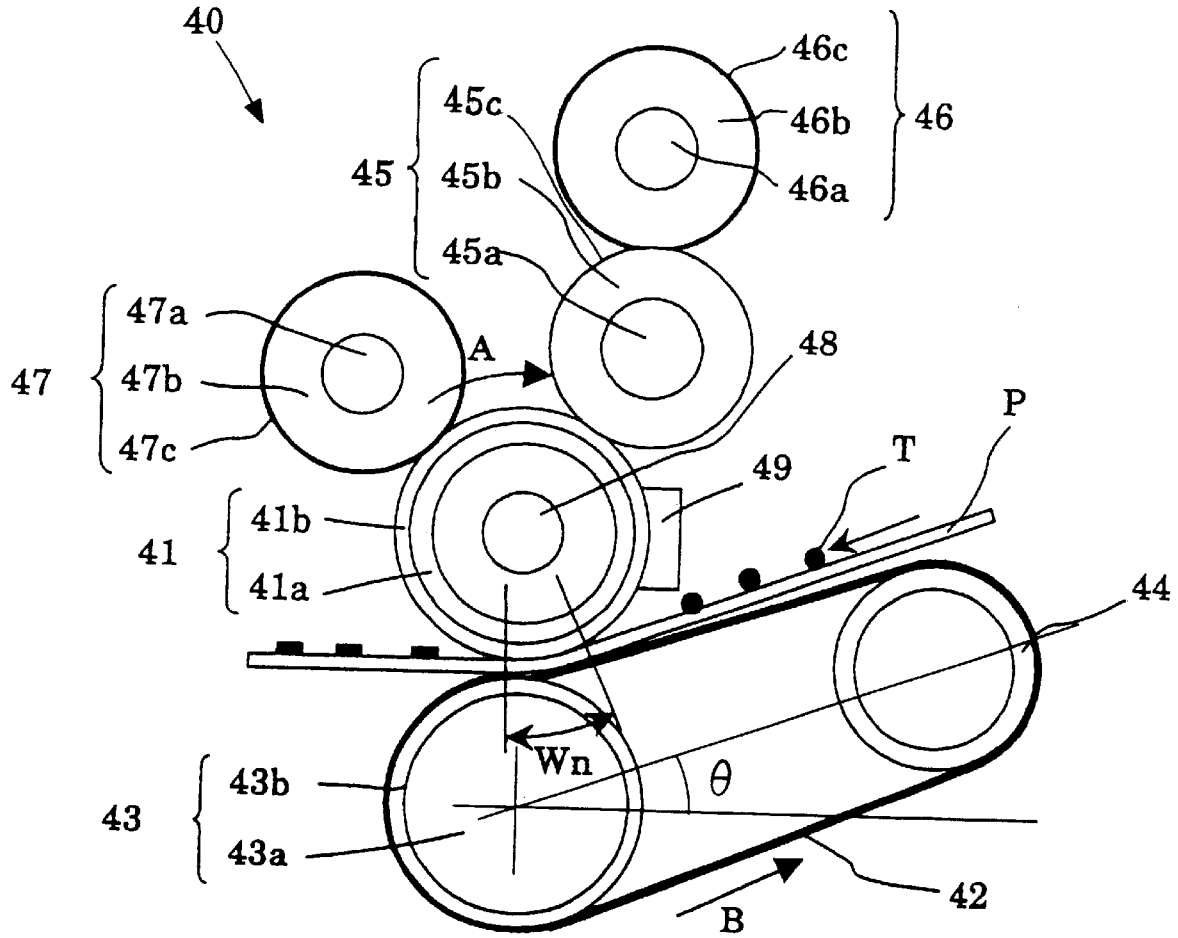
FIG. 16 is a schematic view illustrating the construction of a fixing device representing a second embodiment of the present invention.

FIG. 16 shows a second embodiment of the fixing device 40 according to the present invention. This fixing device is fundamentally the same in construction as that of the fixing device 40 shown in FIG. 2, so that the portions which differ from those of the fixing device 40 shown in FIG. 2 will be explained.

The fixing device 40 is constituted by a fixing roller 41, an endless belt 42, a combination of rollers engaging with and tensioning the endless belt 42, the combination of rollers comprising a pressing roller 43, a tension roller 44 and a donor roller 45, an oil roller 46 and a cleaning roller 47. In this case, the one-way heat fixing method is adopted wherein only the fixing roller 41 which has been heated to a predetermined temperature is designed to give a thermal energy to the recording paper P so as to melt the toner T, and a predetermined pressure is given to the recording paper P by the effects of the fixing roller 41 and the pressing roller 43, thereby fixing the toner T and forming an image of excellent fastness on the recording paper p.

The fixing roller 41 is formed of a fixing member having an outer diameter of 25 mm and composed of an aluminum hollow core 41*a* (2 mm in wall thickness), on the external wall of which a 3-ply covering layer 41*b* is formed. This covering layer 41*b* is impregnated (through dipping) with an off-set preventive agent.

The endless belt 42 constitutes, together with the pressing roller 43, a pressing member and is formed of a material having an excellent heat resistance and being incapable of being impregnated with a silicone oil to be employed as an off-set preventive agent. In this embodiment, an endless belt having a circumferential length of 50 mm and a thickness of 1 mm, and formed of a fluoro-rubber having a heat conductivity of 0.24 W/m° C. is employed while being tensioned at a tensile force of 30N.

The pressing roller 43 is formed of a roller having an outer diameter of 25 mm and disposed at a position which is spaced away from the fixing roller 41 by a shortest distance as measured between the centers thereof. This pressing roller 43 comprises a stainless steel core 43*a* (22 mm in diameter), on the external wall of which an LTV silicone rubber layer 43*b* (thickness: 1.5 mm) is formed. The tension roller 44 is formed of a roller having an outer diameter of 20 mm and disposed on the inlet side for introducing the recording paper P. This tension roller 44 comprises a hollow aluminum core (2 mm in wall thickness), on the external wall of which a fluoro-rubber layer is coated. The endless belt 42, the pressing roller 43 and the tension roller 44 are all designed to be driven by the fixing roller 41 so as to be rotated in the direction of the arrow B at a predetermined velocity.

The fixing nip portion Wn is formed by a partial winding of the endless belt 42 along the circumference of the fixing roller 41. Specifically, the tension roller 44 is disposed at a higher position than that of the pressing roller 43 (i.e. lifted by an angle of θ in relative to the horizontal line passing through the center of the pressing roller 43). The endless belt 42 is wound around the pressing roller 43 and the tension roller 44, thus bridging these rollers 43 and 44. It is designed in this embodiment such that a linear pressure of 0.7 N/mm is to be imposed on the recording paper P by the fixing roller 41 and endless belt 42.

The warm-up of the printer 1 can be accomplished by a process wherein the heater lamp 48 is turned ON under the condition where the fixing roller 41 is suspended, thereby allowing the surface of the fixing roller 41 to rise up to a predetermined temperature (170° C. in this embodiment). The surface temperature of the fixing roller 41 is controlled so as to be kept at a temperature of 170° C. even when the fixing roller 41 is rotated after finishing the warm-up thereof.

Figure 17:
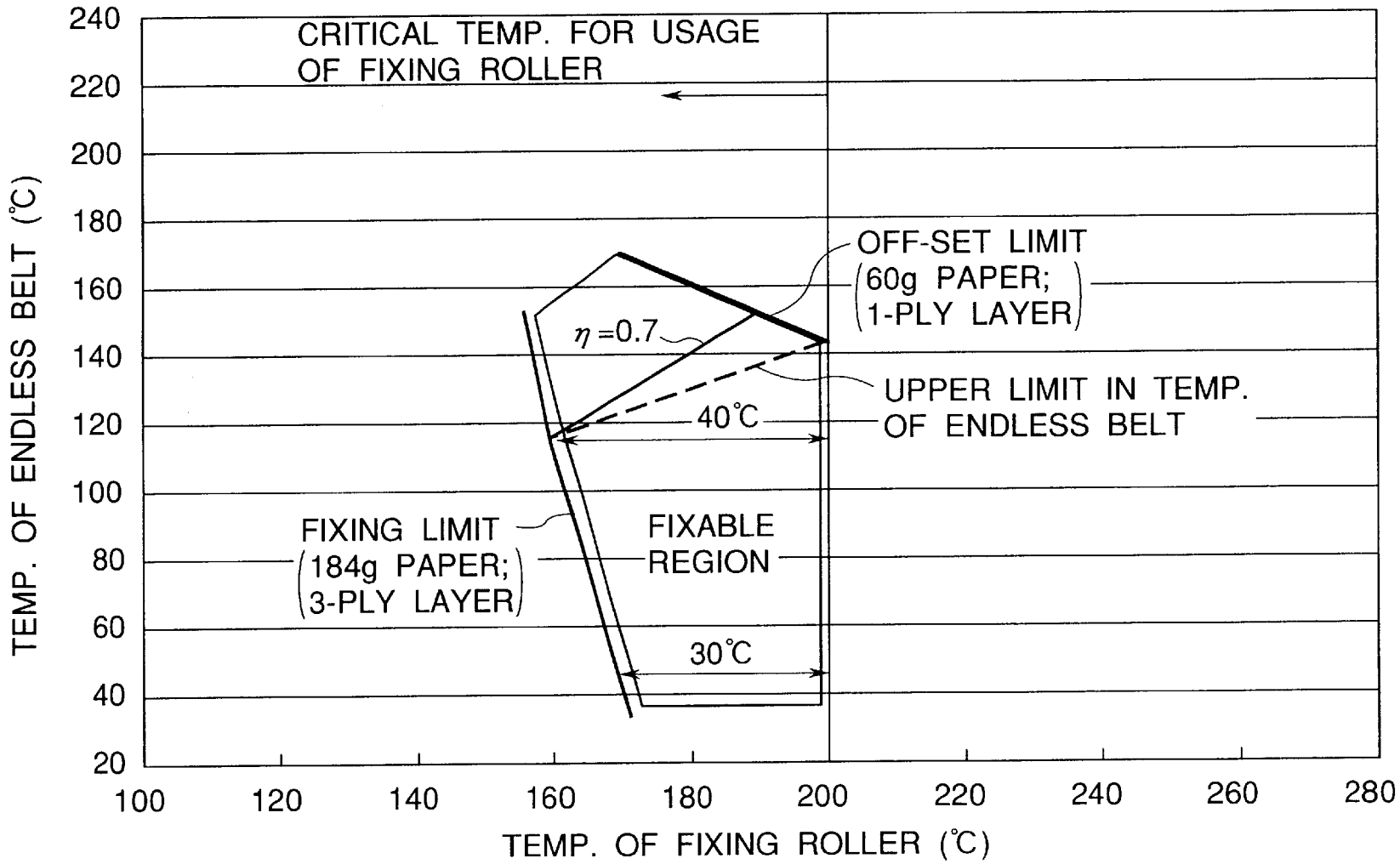
FIG. 17 is a diagram illustrating the result of experiment on the fixable region in the fixing device shown in FIG. 16.

FIG. 17 shows the results of experiment conducted on the fixable region in this embodiment.

In this case, a thin paper having a basis weight of 60 g/m$^2$ and a thick paper having a basis weight of 184 g/m$^2$ were employed as the recording paper P, and the traveling speed of the recording paper P was set to 134 mm/sec.

It will be seen from the results that even if the temperature of the endless belt 42 was increased to a maximum (120 to 140° C.: shown by a broken line), the temperature of the endless belt 42 could be controlled to meet the condition of: $\eta \leqq 0.7$. Because the heat-radiating area of the endless belt 42 was relatively wide, and heat was allowed to release also from the tension roller 44, thus controlling the increase in temperature of the belt.

Therefore, according to the fixing device 40 where the aforementioned endless belt 42 is employed, even if the critical temperature for usage of the fixing roller 41 is set to 200° C., the width of serviceable temperature of the fixing roller 41 can be secured at least 30° C. and at the maximum of 40° C., thus making it possible to realize the one-way heat fixing method.

According to the aforementioned embodiments of the present invention, since the fixing device is constructed as explained above, the following effects can be obtained.

For example, according to the aforementioned first embodiment, since it is designed to measure the relationship between the magnitude Qh of thermal energy to be fed from said fixing roller 41 and the magnitude Qp of thermal energy to be fed from said pressing roller 43 so as to enable the relationship to be controlled within the range of: $Qp/Qh \leqq 0.7$ at the moment of executing the fixing of toner, it has become possible, irrespective of the kinds of recording materials P, to enable the thermal energy to be transmitted to a toner image T at substantially a constant magnitude, so that even if the quantity of oil coated on the fixing roller 41 is relatively small, a wide fixable region can be obtained, and at the same time, the consumption of power can be reduced.

Further, since it is designed to measure the relationship among the difference in temperature Δt between the temperature of an uppermost layer of a developer and the temperature of a lowermost layer of a developer at the moment of finishing the fixing, the transferring speed Vp of the recording material P, and the width Wn of a press-contacted portion to be formed between the fixing roller 41 and the pressing roller 43 in the transferring direction of the recording material so as to enable the relationship to be controlled within the range of: $\Delta t \geqq 0.135\ (Wn/Vp)^{-1.26}$, ($Td = Wn/Vp$), the fixing strength of toner images can be enhanced, and at the same time, an image of high grossness can be obtained.

Further, since the magnitude of thermal energy (Qh) and (Qp) or the aforementioned temperature difference of toner Δt are enabled to be theoretically calculated by making use of the aforementioned heat transfer simulation based on the measurable temperature, etc., the aforementioned fixable region can be easily expected.

Further, according to the fixing device 40, since it is designed to set the relationship between the transferring speed vp of the recording material P, and the width of fixing nip portion Wn formed between the fixing roller 41 and the pressing roller 43 to the range of; $Wn/Vp \geqq 0.047$, it is now possible, irrespective of the critical temperature for usage of the fixing roller 41, to enable a wide fixable region to be secured.

Furthermore, since it is designed to measure the relationship between the thermal conductivity λh of the fixing roller 41 and the thermal conductivity λp of the pressing roller 43 so as to enable the relationship to be controlled to $\lambda h \geqq \lambda p$, it is now possible to shift the fixable region to the lower temperature side relative to the temperature of the fixing roller 41, and it is also possible, within the critical temperature for usage of the fixing roller 41, to enable a wide fixable region to be secured.

Additionally, since the fixing device 40 is provided with the fixing roller 41 which is impregnated with an off-set preventive agent, it is possible, even if a color toner is employed, to secure a wide fixable region by making use of such a small quantity of the off-set preventive agent that can be impregnated into the fixing roller 41. For example, while 20 mg/A4 of coated oil is required in the conventional color fixing device, the quantity of oil required in the present invention can be reduced to 2 mg/A4, i.e. a reduction of cost to about 1/10. Therefore, it is possible to improve the reliability of the fixing device 40, to improve the quality of image, and to reduce the manufacturing cost through the simplification of the oil-coating apparatus.

Further, even if the developer is formed of a monochrome toner containing no wax, a wide fixable region can be secured, thus making it possible in this case also to improve the reliability of the fixing device 40 and the quality of image, and to reduce the cost due to the employment of wax-free toner.

It is possible, through the employment of a recording material P having a basis weight of 184 g/m$^2$ or more in the fixing device 40, to determine the lower limiting line for fixing of the fixable region by way of only the temperature of the fixing roller 41 almost irrespective of the temperature of the pressing roller 43, thereby making it particularly suited for use in a one-way heat fixing method.

Further, since the fixing device 40 is provided with the pressing roller 43 equipped with the detachable contacting mechanism 50 which can be detached from the fixing roller 41, the heat transfer from the fixing roller 41 to the pressing roller 43 at the interval between one recording paper P and the next recording paper P can be inhibited, thereby making it possible to keep the pressing roller 43 in a low temperature condition. As a result, the aforementioned one-way heat fixing system can be easily realized.

Further, according to the aforementioned second embodiment, since the fixing device 40 is provided with a pressing member equipped with the endless belt 42 which is capable of exhibiting a heat-radiating property so as to maintain a low temperature condition of the fixing device 40, it is now also possible to adopt the one-way heat fixing system.

When this endless belt 42 is wound partially around the fixing roller 41, the fixing nip portion Wn having a larger width can be ensured. As a result, even if the temperature of the fixing roller 41 is lowered, the fixing of a toner T can be achieved, thus making it possible, irrespective of the critical temperature for usage of the fixing roller 41, to enable a fixable region to be secured.

By the way, in this embodiment, the experiment or simulation was performed by making use of a specific color toner comprising polyester resin having a glass transition temperature of 52° C. and a softening temperature of 97° C., it is of course possible to employ other kinds of toner to achieve the same results while satisfying the aforementioned conditions regarding the magnitude of thermal energy, etc.

While the present invention has been explained in details with reference to the foregoing embodiments for the purpose of illustration, it will be understood that the construction of the device can be varied without departing from the spirit and scope of the invention as claimed in the following claims.

For example, in the foregoing embodiment, the fixing roller 41 is employed as a fixing member. However, it is also possible to employ a fixing belt as a fixing member in the one-way heat fixing method.

As explained above, according to the device and method of fixing developers proposed by the present invention, since one-way heat fixing method has been adopted as a fixing method of developers, it becomes possible to improve the reliability of the fixing device and the quality of printed image, and at the same time, since the oil-coating device can be simplified, it is possible to minimize the cost and to reduce the power consumption.

What is claimed is:

1. In a fixing device for developers, which comprises a fixing member adapted to be heated, and a pressing member adapted to be contacted with said fixing member, wherein a recording medium carrying an unfixed developer thereon is transferred to an interface between said fixing member and said pressing member so as to allow the surface carrying said unfixed developer thereon to be contacted with said fixing member; the improvement in that;

a magnitude of thermal energy (Qh) to be fed from the fixing member to the developer and the recording medium, and a magnitude of thermal energy (Qp) to be fed from the pressing member to the developer and the recording medium at the moment of fixing process of the developer by means of the fixing member and the pressing member meet the following formula:

$$Qp/Qh \leqq 0.7$$

wherein said magnitude of thermal energies are calculated immediately before the fixing process from the temperatures of said developer, said recording medium, said fixing member and said pressing member; and a difference in temperature between a temperature of an uppermost layer of the developer and the temperature of a lowermost layer of the developer is represented by the following formula:

$$\Delta t \geqq 0.135\ (Wn/Vp)^{-1.26}$$

wherein Δt is the difference in temperature between the temperature of the uppermost layer of the developer and the temperature of the lowermost layer of the developer at the moment of finishing the fixing process, the temperatures of the uppermost layer and the temperature of the lowermost layer being calculated immediately before the fixing process from the temperatures of said developer, said recording medium, said fixing member and said pressing member; Vp is a transferring speed (mm/sec) of said recording medium; and Wn is a width (mm) of a press-contacted portion to be formed between said fixing member and said pressing member in a transferring direction of said recording medium.

2. In a fixing device for developers, which comprises a fixing member adapted to be heated, and a pressing member adapted to be contacted with said fixing member, wherein a recording medium carrying an unfixed developer thereon is transferred to an interface between said fixing member and said pressing member so as to allow the surface carrying said unfixed developer thereon to be contacted with said fixing member; the improvement in that;

a difference in temperature between a temperature of an uppermost layer of the developer and a temperature of a lowermost layer of the developer is represented by the following formula:

$$\Delta t \geqq 0.135\ (Wn/Vp)^{-1.26}$$

wherein Δt is the difference in temperature between the temperature of the uppermost layer of the developer and the temperature of the lowermost layer of the developer at the moment of finishing the fixing process, the temperatures of the uppermost layer and the temperature of the lowermost layer being calculated immediately before the fixing process from the temperatures of said developer, said recording medium, said fixing member and said pressing member; Vp is a transferring speed (mm/sec) of said recording medium; and Wn is a width (mm) of a press-contacted portion to be formed between said fixing member and said pressing member in a transferring direction of said recording medium.

3. The fixing device for developers according to claim 1 or 2, wherein a relationship between Vp and Wn are represented by the following formula:

$$Wn/Vp \geqq 0.047\ (\text{sec.})$$

wherein Vp is a transferring speed (mm/sec) of said recording medium; and Wn is a width (mm) of a press-contacted portion to be formed between said fixing member and said pressing member in a transferring direction of said recording medium.

4. The fixing device for developers according to claim 1 or 2, wherein a relationship between a thermal conductivity of said fixing member and a thermal conductivity of said pressing member is represented by the following formula:

$$\lambda h \geqq \lambda p$$

wherein $\lambda h$ is the thermal conductivity of said fixing member; and $\lambda p$ is the thermal conductivity of said pressing member.

5. The fixing device for developers according to claim 1 or 2, wherein said developer is a color toner, and said fixing member is impregnated with an off-set preventive agent.

6. The fixing device for developers according to claim 1 or 2, wherein said developer is a monochrome toner containing no wax.

7. The fixing device for developers according to claim 1 or 2, wherein said recording medium has a basis weight of 184 $g/m^2$ or more.

8. The fixing device for developers according to claim 1 or 2, wherein said pressing member is provided with a detachable contacting mechanism which can be detached from said fixing member.

9. The fixing device for developers according to claim 1 or 2, wherein said pressing member is provided with an endless belt.

10. The fixing device for developers according to claim 9, wherein said endless belt is wound around said fixing member.

11. A method of fixing developers, which is adapted to be employed in said fixing device as claimed in claim 1 or 2, wherein the method comprises the steps of:

pressing a recording medium, having an unfixed developer thereon, between a fixing member and a pressing member;

controlling the fixing member at a temperature such that a magnitude of thermal energy (Qh) to be fed from the fixing member to the developer and the recording medium, and a magnitude of thermal energy (Qp) to be fed from the pressing member to the developer and the recording medium at the moment of fixing process of the developer by means of the fixing member and the pressing member meet the following formula:

$$QP/Qh \leqq 0.7$$

wherein said magnitude of thermal energies are calculated immediately before the fixing process from the temperatures of said developer, said recording medium, said fixing member and said pressing member; and a difference in temperature between a temperature of an uppermost layer of the developer and the temperature of a lowermost layer of the developer is represented by the following formula:

$$\Delta t \geqq 0.135\ (Wn/Vp)^{-1.26}$$

wherein $\Delta t$ is the difference in temperature between the temperature of the uppermost layer of the developer and the temperature of the lowermost layer of the developer at the moment of finishing the fixing process, the temperatures of the uppermost layer and the temperature of the lowermost layer being calculated immediately before the fixing process from the temperatures of said developer, the recording medium, said fixing member and said pressing member; Vp is a transferring speed (mm/sec) of said recording medium; and Wn is a width (mm) of a press-contacted portion to be formed between said fixing member and said pressing member in a transferring direction of said recording medium.

* * * * *